US010501832B2

(12) United States Patent
Hayashi et al.

(10) Patent No.: US 10,501,832 B2
(45) Date of Patent: Dec. 10, 2019

(54) PLATED STEEL SHEET

(71) Applicant: NIPPON STEEL & SUMITOMO METAL CORPORATION, Tokyo (JP)

(72) Inventors: Koutarou Hayashi, Tokyo (JP); Akihiro Uenishi, Tokyo (JP); Masaharu Kameda, Tokyo (JP); Jun Haga, Tokyo (JP); Kunio Hayashi, Tokyo (JP); Kohichi Sano, Tokyo (JP); Hiroyuki Kawata, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 66 days.

(21) Appl. No.: 15/567,418

(22) PCT Filed: Apr. 22, 2016

(86) PCT No.: PCT/JP2016/062713
§ 371 (c)(1),
(2) Date: Oct. 18, 2017

(87) PCT Pub. No.: WO2016/171237
PCT Pub. Date: Oct. 27, 2016

(65) Prior Publication Data

US 2018/0105908 A1 Apr. 19, 2018

(30) Foreign Application Priority Data

Apr. 22, 2015 (JP) ..... 2015-087714

(51) Int. Cl.
*B32B 15/00* (2006.01)
*C22C 38/58* (2006.01)
(Continued)

(52) U.S. Cl.
CPC ..... *C22C 38/58* (2013.01); *C21D 8/0257* (2013.01); *C21D 9/46* (2013.01); *C22C 38/001* (2013.01);
(Continued)

(58) Field of Classification Search
None
See application file for complete search history.

(56) References Cited

U.S. PATENT DOCUMENTS 8,932,729 B2 * 1/2015 Kawata ..... B21B 1/26 428/336
2007/0190353 A1 8/2007 Taniguchi et al.
(Continued)

FOREIGN PATENT DOCUMENTS

CN 103717773 A 4/2014
EP 2730671 A1 5/2014
(Continued)

OTHER PUBLICATIONS

Krauss G, Martensite in Steel: strength and structure, 1999, Materials Science and Engineering, A273-275, 40-57 (Year: 1999).*
(Continued)

*Primary Examiner* — Seth Dumbris
*Assistant Examiner* — Kim S. Horger
(74) *Attorney, Agent, or Firm* — Birch, Stewart, Kolasch & Birch, LLP

(57) ABSTRACT

A base material (13) included in a plated steel sheet (1) includes a structure, at a ¼ sheet thickness position, represented by, in volume fraction: tempered martensite: 3.0% or more; ferrite: 4.0% or more; and retained austenite: 5.0% or more. An average hardness of the tempered martensite in the base material (13) is 5 GPa to 10 GPa, and a part or all of the tempered martensite and the retained austenite in the base material form an M-A. A volume fraction of ferrite in
(Continued)

a decarburized ferrite layer (12) included in the plated steel sheet (1) is 120% or more of the volume fraction of the ferrite in the base material (13) at the ¼ sheet thickness position, an average grain diameter of the ferrite in the decarburized ferrite layer (12) is 20 μm or less, a thickness of the decarburized ferrite layer (12) is 5 μm to 200 μm, a volume fraction of tempered martensite in the decarburized ferrite layer (12) is 1.0 volume% or more, a number density of the tempered martensite in the decarburized ferrite layer (12) is $0.01/\mu m^2$ or more, and an average hardness of the tempered martensite in the decarburized ferrite layer (12) is 8 GPa or less.

6 Claims, 3 Drawing Sheets

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/06*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C23C 2/40*** | (2006.01) |
| ***C23C 2/02*** | (2006.01) |
| ***C23C 2/06*** | (2006.01) |
| ***C23C 2/28*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/18*** | (2006.01) |
| ***C22C 38/22*** | (2006.01) |
| ***C22C 38/38*** | (2006.01) |

(52) U.S. Cl.

CPC ..... *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/34* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C23C 2/02* (2013.01); *C23C 2/06* (2013.01); *C23C 2/28* (2013.01); *C23C 2/40* (2013.01); *C21D 2211/001* (2013.01); *C21D 2211/005* (2013.01); *C21D 2211/008* (2013.01)

(56) References Cited

U.S. PATENT DOCUMENTS

| | | | | |
|---|---|---|---|---|
| 2012/0152411 | A1* | 6/2012 | Morimoto | B22D 11/115 148/533 |
| 2014/0120371 | A1 | 5/2014 | Mbacke et al. | |
| 2014/0212684 | A1 | 7/2014 | Kawata et al. | |
| 2014/0212686 | A1 | 7/2014 | Imai et al. | |
| 2014/0234659 | A1 | 8/2014 | Kawata et al. | |
| 2014/0234660 | A1 | 8/2014 | Kawata et al. | |
| 2014/0377582 | A1 | 12/2014 | Azuma et al. | |
| 2017/0313028 | A1* | 11/2017 | Kawata | C23C 2/06 |

FOREIGN PATENT DOCUMENTS

| | | | | |
|---|---|---|---|---|
| EP | 2738280 | A1 | 6/2014 | |
| EP | 2813595 | A1 | 12/2014 | |
| JP | 5-195149 | A | 8/1993 | |
| JP | 6-93340 | A | 4/1994 | |
| JP | 6-108152 | A | 4/1994 | |
| JP | 10-130782 | A | 5/1998 | |
| JP | 11-279691 | A | 10/1999 | |
| JP | 2005-256089 | A | 9/2005 | |
| JP | 2006-70328 | A | 3/2006 | |
| JP | 2008-255441 | A | 10/2008 | |
| JP | 2009-19258 | A | 1/2009 | |
| JP | 2011-111675 | A | 6/2011 | |
| JP | 2011-231367 | A | 11/2011 | |
| JP | 2011231367 | A * | 11/2011 | |
| JP | 2013-144830 | A | 7/2013 | |
| JP | 2013-163827 | A | 8/2013 | |
| JP | 2014-19905 | A | 2/2014 | |
| JP | 2014-523478 | A | 9/2014 | |
| WO | WO 2005/087965 | A1 | 9/2005 | |
| WO | WO-2013018739 | A1 * | 2/2013 | C23C 2/28 |
| WO | WO 2013/047760 | A1 | 4/2013 | |
| WO | WO 2013/047821 | A1 | 4/2013 | |

OTHER PUBLICATIONS

Extended European Search Report, dated Aug. 7, 2018, for corresponding European Application No. 16783258.3.

Hryha et al., "On-line Control of Processing Atmospheres for Proper Sintering of Oxidation-sensitive PM Steels," Journal of Materials Processing Technology, vol. 212, No. 4, 2012 (Available online Dec. 16, 2011), pp. 977-987, XP028885200.

International Search Report for PCT/JP2016/062713 dated Jul. 26, 2016.

Written Opinion of the International Searching Authority for PCT/JP2016/062713 (PCT/ISA/237) dated Jul. 26, 2016.

English translation of the International Preliminary Report on Patentability and Written Opinion of the International Searching Authority (Forms PCT/IB/338, PCT/IB/373 and PCT/ISA/237) dated Nov. 2, 2017, for International Application No. PCT/JP2016/062713.

Chinese Office Action, dated Oct. 24, 2018, for corresponds Chinese Application No. 201680022562.3, along with an English translation.

* cited by examiner

PLATED STEEL SHEET

TECHNICAL FIELD

The present invention relates to a plated steel sheet suitable for application such as a vehicle body of an automobile in which it is subjected to press forming.

BACKGROUND ART

In recent years, it has been required to improve fuel economy of an automobile for the purpose of global environment conservation, and needs for a high-strength steel sheet have been increasing in order to reduce weight of a vehicle body and to secure safety of a passenger. It is insufficient that a steel sheet used for a member for automobile has only high strength, and the steel sheet is required to have high corrosion resistance, good press formability, and good bendability.

As a hot-dip galvanized steel sheet having good elongation, a steel sheet utilizing TRIP (Transformation Induced Plasticity) effect of retained austenite is known. For example, Patent Literature 1 discloses a high-tensile hot-dip galvanized steel sheet made for the purpose of improving strength and ductility. However, if hard martensite is contained in a steel sheet for the purpose of high-strengthening, formability of the steel sheet deteriorates.

Other than the Patent Literature 1, Patent Literatures 2 to 14 disclose techniques for the purpose of improving mechanical properties of a steel sheet such as performing tempering of martensite. However, even with these conventional techniques, it is difficult to improve the elongation property and the formability of a plated steel sheet while obtaining high strength. Specifically, although the formability may be improved by performing the tempering, it is not possible to avoid reduction in strength caused by the tempering.

CITATION LIST

Patent Literature

Patent Literature 1: Japanese Laid-open Patent Publication No. 11-279691

Patent Literature 2: Japanese Laid-open Patent Publication No. 6-93340

Patent Literature 3: Japanese Laid-open Patent Publication No. 6-108152

Patent Literature 4: Japanese Laid-open Patent Publication No. 2005-256089

Patent Literature 5: Japanese Laid-open Patent Publication No. 2009-19258

Patent Literature 6: Japanese Laid-open Patent Publication No. 5-195149

Patent Literature 7: Japanese Laid-open Patent Publication No. 10-130782

Patent Literature 8: Japanese Laid-open Patent Publication No. 2006-70328

Patent Literature 9: Japanese Laid-open Patent Publication No. 2011-231367

Patent Literature 10: Japanese Laid-open Patent Publication No. 2013-163827

Patent Literature 11: International Publication No. WO 2013/047760

Patent Literature 12: International Publication No. WO 2013/047821

Patent Literature 13: Japanese Laid-open Patent Publication No. 2014-19905

Patent Literature 14: Japanese Laid-open Patent Publication No. 2008-255441

SUMMARY OF INVENTION

Technical Problem

The present invention has an object to provide a plated steel sheet capable of improving an elongation property and bendability while obtaining high strength.

Solution to Problem

The present inventors conducted earnest studies in order to improve an elongation property and bendability of a plated steel sheet having high strength, and as a result of this, they found out that the elongation property is improved when a form of martensite and retained austenite is a M-A (Martensite-Austenite constituent, also known as island martensite). Here, as described in the Literature "Journal of the JWS Vol. 50 (1981), No. 1, pp. 37-46", the M-A indicates a region of complex of martensite and retained austenite generated in martensite transformation during cooling after concentration of C in non-transformed austenite is caused in ferrite transformation or bainite transformation, and is dispersed in an island form in a matrix.

Meanwhile, excessively hard martensite deteriorates bendability. Accordingly, the present inventors further conducted earnest studies repeatedly for improving the bendability. As a result, they found out that when a decarburized ferrite layer is formed before causing the generation of M-A, and after the generation of M-A, the M-A is tempered at a temperature at which the retained austenite is remained, it is also possible to improve the bendability while maintaining good elongation property. Further, the inventors of the present application arrived at various embodiments of the invention to be described below. Note that the concept of plated steel sheet includes a plated steel strip as well.

(1) A plated steel sheet, comprising:

a steel sheet; and a plating layer on the steel sheet, wherein:

the plating layer is a hot-dip galvanizing layer or an alloyed hot-dip galvanizing layer;

the steel sheet comprises:

a base material; and a decarburized ferrite layer on the base material;

the base material includes a chemical composition represented by, in mass %:

C: 0.03% to 0.70%;
Si: 0.25% to 3.00%;
Mn: 1.0% to 5.0%;
P: 0.10% or less;
S: 0.0100% or less;
sol. Al: 0.001% to 1.500%;
N: 0.02% or less;
Ti: 0.0% to 0.300%;
Nb: 0.0% to 0.300%;
V: 0.0% to 0.300%;
Cr: 0% to 2.000%;
Mo: 0% to 2.000%;
Cu: 0% to 2.000%;
Ni: 0% to 2.000%;
B: 0% to 0.0200%;
Ca: 0.00% to 0.0100%;
REM: 0.0% to 0.1000%;
Bi: 0.00% to 0.0500%; and
the balance: Fe and impurities;

the base material includes a structure, at a position at which a depth from a surface of the steel sheet corresponds to ¼ of a thickness of the steel sheet, represented by, in volume fraction:

tempered martensite: 3.0% or more;

ferrite: 4.0% or more; and retained austenite: 5.0% or more;

an average hardness of the tempered martensite in the base material is 5 GPa to 10 GPa;

a part or all of the tempered martensite and the retained austenite in the base material form an M-A;

a volume fraction of ferrite in the decarburized ferrite layer is 120% or more of the volume fraction of the ferrite in the base material at the position at which the depth from the surface of the steel sheet corresponds to ¼ of the thickness of the steel sheet;

an average grain diameter of the ferrite in the decarburized ferrite layer is 20 μm or less;

a thickness of the decarburized ferrite layer is 5 μm to 200 μm;

a volume fraction of tempered martensite in the decarburized ferrite layer is 3.0 volume % or more;

a number density of the tempered martensite in the decarburized territe layer is $0.01/\mu m^2$ or more; and an average hardness of the tempered martensite in the decarburized ferrite layer is 8 GPa or less.

(2) The plated steel sheet according to (1), wherein, in the chemical composition, Ti: 0.001% to 0.300%, Nb: 0.001% to 0.300%, or V: 0.001% to 0.300%, or any combination thereof is satisfied.

(3) The plated steel sheet according to (1) or (2), wherein, in the chemical composition, Cr: 0.001% to 2.000%, or Mo: 0.001% to 2.000%, or both of them is satisfied.

(4) The plated steel sheet according to any one of (1) to (3), wherein, in the chemical composition, Cu: 0.001% to 2.000%, or Ni: 0.001% to 2.000%, or both of them is satisfied.

(5) The plated steel sheet according to any one of (1) to (4), wherein, in the chemical composition, B: 0.0001% to 0.0200% is satisfied.

(6) The plated steel sheet according to any one of (1) to (5), wherein, in the chemical composition, Ca: 0.0001% to 0.0100%, or REM: 0.0001% to 0.1000%, or both of them is satisfied.

(7) The plated steel sheet according to any one of (1) to (6), wherein, in the chemical composition, Bi: 0.0001% to 0.0500% is satisfied.

Advantageous Effects of Invention

According to the present invention, a base material and a decarburized ferrite layer includes an appropriate configuration, so that it is possible to improve an elongation property and bendability while obtaining high strength.

DESCRIPTION OF EMBODIMENTS

Hereinafter, a plated steel sheet according to embodiments of the present invention will be described while referring to the attached drawings.

Figure 1:
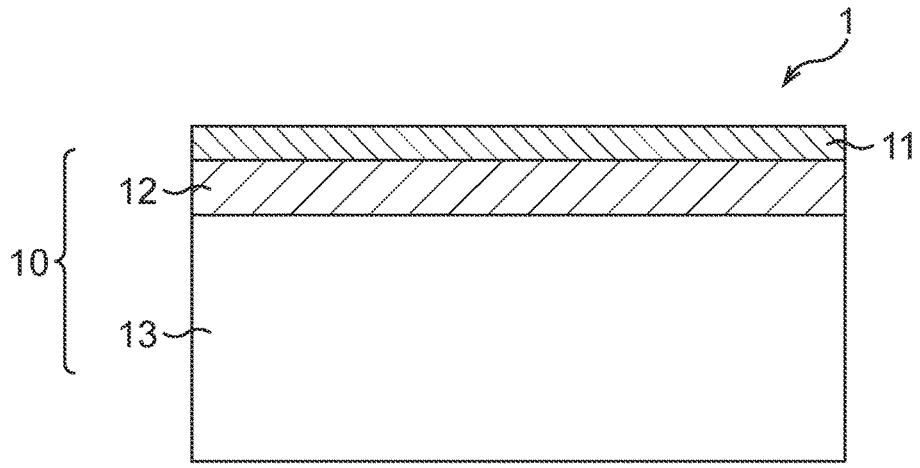
FIG. 1 is a sectional view illustrating a plated steel sheet according to an embodiment of the present invention.

FIG. 1 is a sectional view illustrating a plated steel sheet according to an embodiment of the present invention.

As illustrated in FIG. 1, a plated steel sheet 1 according to the present embodiment includes a steel sheet 10, and a plating layer 11 on the steel sheet 10. The steel sheet 10 includes a base material 13, and a decarburized ferrite layer 12 on the base material 13. The plating layer 11 is a hot-dip galvanizing layer or an alloyed hot-dip galvanizing layer. The decarburized ferrite layer 12 is between the base material 13 and the plating layer 11.

Here, a chemical composition of the base material 13 and a raw material steel sheet used for manufacturing the plated steel sheet 1 will be described. Although details will be described later, the plated steel sheet 1 is manufactured by making a raw material steel sheet to be subjected to heating, annealing, first cooling, second cooling, hot-dip galvanizing, third cooling, and the like. Alloying may be performed between the plating and the third cooling. Therefore, the chemical composition of the base material 13 and the raw material steel sheet takes not only properties of the plated steel sheet 1 but also these treatments into consideration. In the description hereinbelow, "%" being a unit of content of each element contained in the base material 13 and the raw material steel sheet means "mass %", unless otherwise specified. The base material 13 and the raw material steel sheet includes a chemical composition represented by C: 0.03% to 0.70%, Si: 0.25% to 3.00%, Mn: 1.0% to 5.0%, P: 0.10% or less, S: 0.0100% or less, acid-soluble Al (sol. Al): 0.001% to 1.500%, N: 0.02% or less, Ti: 0.0% to 0.300%, Nb: 0.0% to 0.300%, V: 0.0% to 0.300%, Cr: 0% to 2.000%, Mo: 0% to 2.000%, Cu: 0% to 2.000%, Ni: 0% to 2.000%, B: 0% to 0.0200%, Ca: 0.00% to 0.0100%, rare earth metal (REM): 0.0% to 0.1000%, Bi: 0.00% to 0.0500%, and the balance: Fe and impurities. As the impurity, one contained in a raw material such as ore or scrap and one contained in a manufacturing process may be exemplified.

(C: 0.03% to 0.70%)

C contributes to improvement of tensile strength. If the C content is less than 0.03%, it is not possible to obtain sufficient tensile strength. Therefore, the C content is 0.03% or more, and preferably 0.05% or more. On the other hand, if the C content exceeds 0.70%, weldability of the plated steel sheet 1 is lowered. Therefore, the C content is 0.70% or less, and preferably 0.45% or less.

(Si: 0.25% to 3.00%)

Si suppresses precipitation of cementite and makes it easy for austenite to be retained, to thereby contribute to improvement of elongation. Si also contributes to strengthening of ferrite, uniformization of structure, and improvement of strength. If the Si content is less than 0.25%, these effects cannot be sufficiently obtained. Therefore, the Si content is 0.25% or more, and preferably 0.40% or more. Si also contributes to generation of austenite and growth of the decarburized ferrite layer 12. In order to sufficiently obtain this effect, the Si content is more preferably 0.60% or more. On the other hand, if the Si content exceeds 3.00%, plating defect may occur in hot-dip galvanizing. Therefore, the Si content is 3.00% or less, and preferably set to 2.50% or less.

(Mn: 1.0% to 5.0%) Mn makes tempered martensite sufficiently disperse in the decarburized ferrite layer 12, to thereby contribute to improvement of number density of the tempered martensite in the decarburized ferrite layer 12. Mn suppresses precipitation of cementite to facilitate generation of M-A, and contributes also to improvement of strength and elongation. If the Mn content is less than 1.0%, these effects cannot be sufficiently obtained. Therefore, the Mn content is 1.0% or more, and preferably 1.9% or more. On the other hand, if the Mn content exceeds 5.0%, the weldability of the plated steel sheet 1 is lowered. Therefore, the Mn content is 5.0% or less, preferably 4.2% or less, and more preferably set to 3.5% or less.

(P: 0.10% or less)

P is not an essential element, and is contained in the steel as an impurity, for example. P deteriorates the weldability, so that the lower the P content, the better. In particular, if the P content exceeds 0.10%, the weldability is significantly lowered. Therefore, the P content is 0.10% or less, and preferably 0.02% or less.

(S: 0.0100% or less)

S is not an essential element, and is contained in the steel as an impurity, for example. S forms MnS in the steel to deteriorate hole expandability, so that the lower the S content, the better. In particular, if the S content exceeds 0.0100%, the hole expandability is significantly lowered. Therefore, the S content is 0.0100% or less, preferably 0.0050% or less, and more preferably 0.0012% or less.

(sol. Al: 0.001% to 1.500%)

Sol. Al has a deoxidation effect, suppresses generation of surface flaw, and improves productivity. If the sol. Al content is less than 0.001%, these effects cannot be sufficiently obtained. Therefore, the sol. Al content is 0.001% or more. Similar to Si, sol. Al suppresses the precipitation of cementite to make it easy for austenite to be retained. In order to sufficiently obtain this effect, the sol. Al content is preferably 0.200% or more. On the other hand, if the sol. Al content exceeds 1.500%, an inclusion increases to deteriorate the hole expandability. Therefore, the sol. Al content is 1.500% or less, and preferably 1.000% or less.

(N: 0.02% or less)

N is not an essential element, and is contained in the steel as an impurity, for example. N forms a nitride during continuous casting in forming the raw material steel sheet, which sometimes causes occurrence of crack in a slab, so that the lower the N content, the better. In particular, if the N content exceeds 0.02%, the crack in the slab easily occurs. Therefore, the N content is 0.02% or less, and preferably 0.01% or less.

Ti, Nb, V, Cr, Mo, Cu, Ni, B, Ca, REM, and Bi are not essential elements, and are optional elements which may be appropriately contained in a steel sheet and a slab in an amount up to a specific amount as a limit.

(Ti: 0.0% to 0.300%, Nb: 0.0% to 0.300%, V: 0.0% to 0.300%)

Ti, Nb, and V generate precipitates to be nuclei of grains, and thus contribute to refinement of grains. The refinement of grains leads to improvement of strength and toughness. Therefore, Ti, Nb, or V, or any combination thereof may also be contained. In order to sufficiently obtain this effect, each of the Ti content, the Nb content, and the V content is preferably 0.001% or more. On the other hand, if one of the Ti content, the Nb content, and the V content exceeds 0.300%, the effect is saturated and the cost is unnecessarily increased. Therefore, each of the Ti content, the Nb content, and the V content is 0.300% or less. Specifically, it is preferable to satisfy the condition of "Ti: 0.001% to 0.300%," "Nb: 0.001% to 0.300%," or "V: 0.001% to 0.300%," or any combination thereof. Ti and Nb facilitate the concentration of C in austenite caused by the generation of ferrite, in first cooling, in a raw material steel sheet in which at least a part of a structure is transformed into austenite in annealing, so that the M-A is easily generated. In order to sufficiently obtain this effect, Ti or Nb, or both of them is/are more preferably contained in an amount of 0.010% or more in total, and still more preferably contained in an amount of 0.030% or more in total.

(Cr: 0% to 2.000%, Mo: 0% to 2.000%)

Cr and Mo stabilize austenite to contribute to improvement of strength owing to the generation of martensite. Therefore, Cr or Mo, or both of them may also be contained. In order to sufficiently obtain this effect, the Cr content is preferably 0.001% or more, and more preferably 0.100% or more, and the Mo content is preferably 0.001% or more, and more preferably 0.050% or more. On the other hand, if the Cr content or the Mo content exceeds 2.000%, the effect is saturated and the cost is unnecessarily increased. Therefore, the Cr content is 2.000% or less, and preferably 1.000% or less, and the Mo content is 2.000% or less, and preferably 0.500% or less. Specifically, it is preferable to satisfy the condition of "Cr: 0.001% to 2.000%," or "Mo: 0.001% to 2.000%," or both of them.

(Cu: 0% to 2.000%, Ni: 0% to 2.000%)

Cu and Ni suppress corrosion of the plated steel sheet 1, and concentrate in a surface of the plated steel sheet 1 to suppress entrance of hydrogen into the plated steel sheet 1, thereby suppressing delayed fracture of the plated steel sheet 1. Therefore, Cu or Ni, or both of them may also be contained. In order to sufficiently obtain this effect, each of the Cu content and the Ni content is preferably 0.001% or more, and more preferably 0.010% or more. On the other hand, if the Cu content or the Ni content exceeds 2.000%, the effect is saturated and the cost is unnecessarily increased. Therefore, each of the Cu content and the Ni content is 2.000% or less, and preferably 0.800% or less. Specifically, it is preferable to satisfy the condition of "Cu: 0.001% to 2.000%," or "Ni: 0.001% to 2.000%," or both of them.

(B: 0% to 0.0200%)

B suppresses nucleation of ferrite from a grain boundary, and enhances hardenability of the plated steel sheet 1, to thereby contribute to high-strengthening of the plated steel sheet 1. B also contributes to improvement of elongation of the plated steel sheet 1 by effectively generating the M-A. Therefore, B may also be contained. In order to sufficiently obtain this effect, the B content is preferably 0.0001% or more. On the other hand, if the B content exceeds 0.0200%, the effect is saturated and the cost is unnecessarily increased. Therefore, the B content is 0.0200% or less. Specifically, it is preferable to satisfy the condition of "B: 0.0001% to 0.0200%."

(Ca: 0.00% to 0.0100%, REM: 0.0% to 0.1000%)

Ca and REM spheroidize a sulfide to improve expandability of the plated steel sheet 1. Therefore, Ca or REM, or both of them may also be contained. In order to sufficiently obtain this effect, each of the Ca content and the REM content is preferably 0.0001% or more. On the other hand, if the Ca content exceeds 0.0100% or if the REM content exceeds 0.1000%, the effect is saturated and the cost is unnecessarily increased. Therefore, the Ca content is 0.0100% or less, and the REM content is 0.1000% or less.

Specifically, it is preferable to satisfy the condition of "Ca: 0.0001% to 0.0100%," or "REM: 0.0001% to 0.1000%," or both of them.

REM indicates 17 kinds of elements in total of Sc, Y, and lanthanoide series, and "REM content" means a total content of these 17 kinds of elements. Industrially, the lanthanoide series are added in a form of misch metal, for example.

(Bi: 0.00% to 0.0500%)

Bi concentrates in a solidification interface to narrow a dendrite interval, to thereby suppress solidifying segregation. When micro-segregation of Mn or the like occurs, there is a chance that a band structure with nonuniform hardness develops, and workability lowers, and Bi suppresses reduction of properties caused by such micro-segregation. Therefore, Bi may also be contained. In order to sufficiently obtain this effect, the Bi content is preferably 0.0001% or more, and more preferably 0.0003% or more. On the other hand, if the Bi content exceeds 0.0500%, a surface quality deteriorates. Therefore, the Bi content is 0.0500% or less, preferably 0.0100% or less, and more preferably 0.0050% or less. Specifically, it is preferable to satisfy the condition of "Bi: 0.0001% to 0.0500%."

Next, the base material 13 will be described. A position at which a structure of the base material is defined is a position at which a depth from a surface of the steel sheet 10 corresponds to ¼ of a thickness of the steel sheet 10. This position is sometimes referred to as "¼ sheet thickness position," hereinafter. This is because the ¼ sheet thickness position is generally considered to be a position at which average configuration and properties of the steel sheet are exhibited. Normally, a structure at a position other than the ¼ sheet thickness position of the base material 13 is substantially the same as the structure at the ¼ sheet thickness position. In the description hereinbelow, "%" being a unit of volume fraction of each structure contained in the base material 13 means "volume %," unless otherwise specified. The base material 13 includes, at the position at which the depth from the surface of the steel sheet 10 corresponds to ¼ of the thickness of the steel sheet 10, a structure represented by, in volume fraction, 3.0% or more of tempered martensite, and 5.0% or more of retained austenite. An average hardness of the tempered martensite in the base material 13 is 5 GPa to 10 GPa, a part or all of the tempered martensite and the retained austenite in the base material 13 form the M-A. In order to obtain the plated steel sheet 1 having good workability and tensile strength of 780 MPa or more, it is effective to make the structure of the base material 13 to be a structure obtained by performing tempering on the structure containing the M-A at a temperature at which the retained austenite remains. When the base material 13 has such a structure, local elongation is improved while maintaining good total elongation realized by the M-A.

(Tempered martensite: 3.0% or more)

The tempered martensite contributes to improvement of bendability. If the volume fraction of the tempered martensite is less than 3.0%, it is not possible to obtain sufficient bendability.

Therefore, the volume fraction of the tempered martensite is 3.0% or more, and preferably 5.0% or more. The tempered martensite also contributes to improvement of strength, and in order to obtain higher strength, the volume fraction of the tempered martensite is preferably 8.0% or more.

(Retained Austenite: 5.0% or More)

The retained austenite contributes to improvement of elongation. If the volume fraction of the retained austenite is less than 5.0%, it is not possible to obtain sufficient elongation. Therefore, the volume fraction of the retained austenite is 5.0% or more. The retained austenite also contributes to improvement of strength, and in order to obtain higher strength, the volume fraction of the retained austenite is preferably 8.0% or more.

(Average hardness of tempered martensite: 5 GPa to 10 GPa)

If the average hardness of the tempered martensite is less than 5 GPa, it is not possible to obtain sufficient strength, for example, tensile strength of 780 MPa or more. Therefore, the average hardness of the tempered martensite in the base material 13 is 5 GPa or more. On the other hand, if the average hardness of the tempered martensite exceeds 10 GPa, a crack easily occurs when bending is applied, resulting in that excellent bendability cannot be achieved. Therefore, the average hardness of the tempered martensite in the base material 13 is 10 GPa or less. The average hardness of the tempered martensite can be measured by a nano-indentation method. In the measurement, for example, an indenter having a shape of cube corner is used, and an indentation load is 500 μN.

(M-A)

In the present embodiment, a part or all of the tempered martensite and the retained austenite in the base material 13 form the M-A. The M-A contributes to improvement of total elongation (T. El). In order to obtain further excellent bendability, the entire martensite contained in the base material 13 is preferably the tempered martensite.

(Balance)

It is preferable that the balance of the base material 13 is mainly composed of ferrite or of ferrite and bainite. If the volume fraction of ferrite is less than 4.0%, there is a chance that sufficient elongation property and bendability cannot be obtained. Therefore, the volume fraction of ferrite in the base material 13 is 4.0% or more from a viewpoint of mechanical property such as tensile strength. On the other hand, if the volume fraction of ferrite exceeds 70%, there is a chance that sufficient strength cannot be obtained. Therefore, the volume fraction of ferrite in the base material 13 is preferably 70% or less. It is preferable that no cementite having a circle-equivalent diameter of 5 μm or more exists in a grain of ferrite and a grain of martensite in the base material 13. This is for facilitating the generation of M-A.

Figure 2:
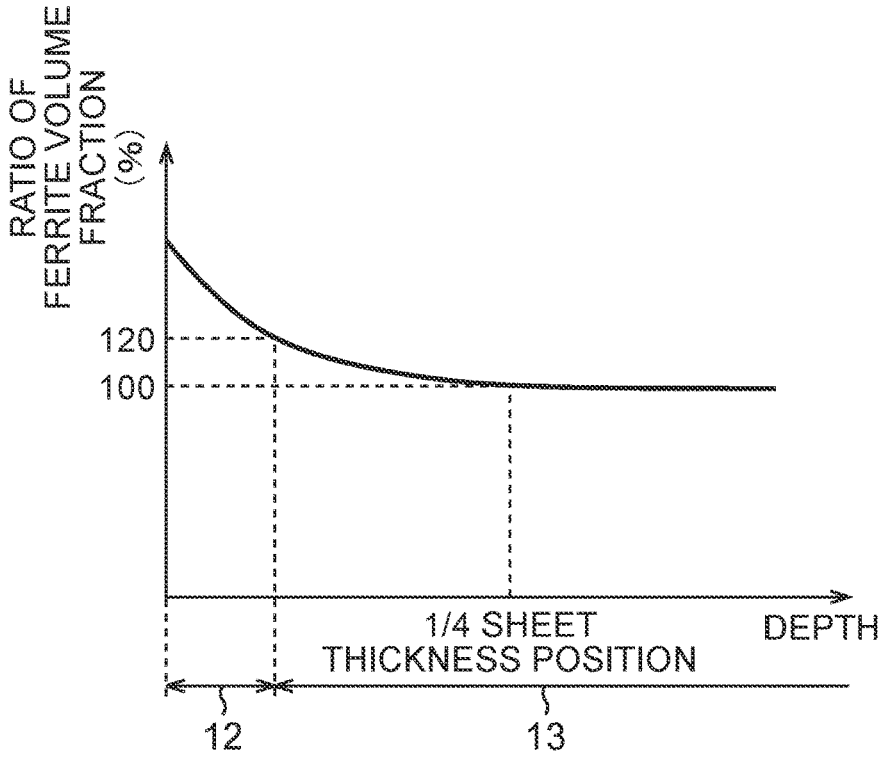
FIG. 2 is a chart illustrating an outline of a distribution of volume fraction of ferrite in a steel sheet.

Next, the decarburized ferrite layer 12 will be described. The decarburized ferrite layer 12 is a layer formed on the base material 13 as a result of making a surface of the raw material steel sheet to be subjected to decarburization during annealing, and in which a volume fraction of ferrite is 120% or more of a volume fraction of ferrite in the base material 13 at the ¼ sheet thickness position. Specifically, in the present embodiment, the volume fraction of ferrite is measured at intervals of 1 μm from the surface of the steel sheet 10, and it is defined that an interface between the decarburized ferrite layer 12 and the base material 13 exists at a position at which the measurement result shows 120% of the volume fraction of ferrite at the ¼ sheet thickness position of the steel sheet 10, and accordingly, a portion on a surface side of the steel sheet 10 with respect to the interface can be regarded as the decarburized ferrite layer 12. FIG. 2 illustrates an outline of a distribution of the volume fraction of ferrite in the steel sheet 10. A vertical axis in FIG. 2 indicates a proportion when the volume fraction of ferrite at the ¼ sheet thickness position is set to 100%.

The decarburized ferrite layer 12 is softer than the base material 13 since the decarburized ferrite layer 12 contains C in an amount smaller than that of the base material 13, so that even if the plated steel sheet 1 is bent, a crack is difficult to occur in the decarburized ferrite layer 12. Further, since the decarburized ferrite layer 12 is easily deformed uniformly, constriction is difficult to occur in the decarburized ferrite layer 12. Therefore, the decarburized ferrite layer 12 improves bendability of the plated steel sheet 1.

The present inventors repeatedly conducted earnest studies by focusing attention on the fact that although decarburization of a raw material steel sheet is performed also in a conventional plated steel sheet, it is not possible to achieve sufficient bendability. As a result, it was clarified that in the conventional plated steel sheet, an average grain diameter of ferrite in the decarburized ferrite layer is large to be 20 μm or more and a fine crack occurs in a decarburized ferrite layer since deformation intensively occurs in a grain boundary of ferrite when bending deformation of the steel sheet occurs. Further, the present inventors found out that in order to solve this problem, it is effective to reduce the average grain diameter of ferrite in the decarburized ferrite layer, and to disperse tempered martensite provided with the specified average hardness in the decarburized ferrite layer. In the present embodiment, an average grain diameter of ferrite in the decarburized ferrite layer 12 is 20 μM or less, a thickness of the decarburized ferrite layer 12 is 5 μm to 200 μm, a volume fraction of the tempered martensite in the decarburized ferrite layer 12 is 1.0 volume % or more, a number density of the tempered martensite in the decarburized ferrite layer 12 is $0.01/\mu m^2$ or more, and an average hardness of the tempered martensite in the decarburized ferrite layer 12 is 8 GPa or less.

(Average grain diameter of ferrite: 20 μm or less)

The volume fraction of ferrite in the decarburized ferrite layer 12 is 120% or more of the volume fraction of ferrite in the base material 13 at the ¼ sheet thickness position. If the average grain diameter of ferrite in the decarburized ferrite layer 12 exceeds 20 μm, a total area of the grain boundary of ferrite is small, and deformation intensively occurs in a narrow region, resulting in that excellent bendability of the plated steel sheet 1 cannot be obtained. Therefore, the average grain diameter of ferrite is 20 μm or less. The smaller the average grain diameter of ferrite, the more preferable, but, it is difficult to make the average grain diameter of ferrite 0.5 μm or less under the current technical level.

(Thickness: 5 μm to 200 μm)

If the thickness of the decarburized ferrite layer 12 is less than 5 μm, it is not possible to sufficiently achieve the effect of improvement of bendability realized by the decarburized ferrite layer 12. For this reason, when the plated steel sheet 1 is bent, the base material 13 whose strength is higher than that of the decarburized ferrite layer 12 is deformed to cause a microcrack. Therefore, the thickness of the decarburized ferrite layer 12 is 5 μm or more. If the thickness of the decarburized ferrite layer 12 exceeds 200 μm, it is not possible to obtain sufficient tensile strength. Therefore, the thickness of the decarburized ferrite layer 12 is 200 μm or more.

(Volume fraction of tempered martensite: 1.0 volume % or more)

If the volume fraction of the tempered martensite in the decarburized ferrite layer 12 is less than 1.0 volume %, nonuniform deformation easily occurs in the plated steel sheet 1, resulting in that excellent bendability cannot be obtained. Therefore, the volume fraction of the tempered martensite in the decarburized ferrite layer 12 is 1.0 volume % or more. The decarburized ferrite layer 12 is formed through the decarburization of the raw material steel sheet, so that there is no chance that the volume fraction of the tempered martensite in the decarburized ferrite layer 12 exceeds the volume fraction of the tempered martensite in the base material 13. If the volume fraction of the tempered martensite in the decarburized ferrite layer 12 exceeded the volume fraction of the tempered martensite in the base material 13, this would mean that no decarburization occurred in the decarburized ferrite layer 12. Therefore, the volume fraction of the tempered martensite in the decarburized ferrite layer 12 is equal to or less than the volume fraction of the tempered martensite in the base material 13. In the present embodiment, the martensite contained in the decarburized ferrite layer 12 is not fresh martensite (untempered martensite) but the tempered martensite, so that it is possible to suppress occurrence of crack at an interface between ferrite and martensite.

The balance of the structure of the decarburized ferrite layer 12 is mainly composed of ferrite. As described above, the area fraction of ferrite in the decarburized ferrite layer 12 is 120% or more of the area fraction of ferrite in the base material 13 at the ¼ sheet thickness position. The balance of the structure of the decarburized ferrite layer may also contain, for example, bainite, pearlite, and the like, within a range of exerting no influence on the properties of the plated steel sheet 1 according to the present embodiment, for example, within a range of 5 volume % or less.

(Number density of tempered martensite: $0.01/\mu m^2$ or more)

If the number density of the tempered martensite in the decarburized ferrite layer 12 is less than $0.01/\mu m^2$, nonuniform deformation easily occurs in the plated steel sheet 1, resulting in that excellent bendability cannot be obtained. Therefore, the number density of the tempered martensite in the decarburized ferrite layer 12 is $0.01/\mu m^2$ or more. The higher the number density of the tempered martensite, the better, but, it is difficult to make the number density $1/\mu m^2$ or more, under the current technical level.

(Average hardness of tempered martensite: 8 GPa or less)

If the average hardness of the tempered martensite in the decarburized ferrite layer 12 exceeds 8 GPa, a crack easily occurs in the decarburized ferrite layer 12 when the plated steel sheet 1 is bent, and thus excellent bendability cannot be obtained. Therefore, the average hardness of the tempered martensite in the decarburized ferrite layer 12 is 8 GPa or less. Although a lower limit of the average hardness of the tempered martensite in the decarburized ferrite layer 12 is not limited, when tempering is performed to a degree at which high strength of the plated steel sheet 1 is secured, the average hardness of the tempered martensite in the decarburized ferrite layer 12 does not become less than 4 GPa. The average hardness of the tempered martensite in the decarburized ferrite layer 12 is smaller than the average hardness of the tempered martensite in the base material 13.

With the use of the plated steel sheet 1 according to the present embodiment, it is possible to improve the elongation property and the bendability while obtaining high strength. For example, in a tensile test in which a sheet width direction (a direction perpendicular to a rolling direction) is set as a tensile direction, it is possible to obtain tensile strength (TS) of 780 MPa or more, yield strength (YS) of 420 MPa or more, and total elongation (T. El) of 12% or more. Further, for example, in a hole expansion test, it is possible to obtain a hole expansion ratio of 35% or more, and regarding the bendability, it is possible to obtain a result such that in a 90-degree V-shaped bending test, no crack occurs and no constriction of 10 μm or more occurs.

Figure 3:
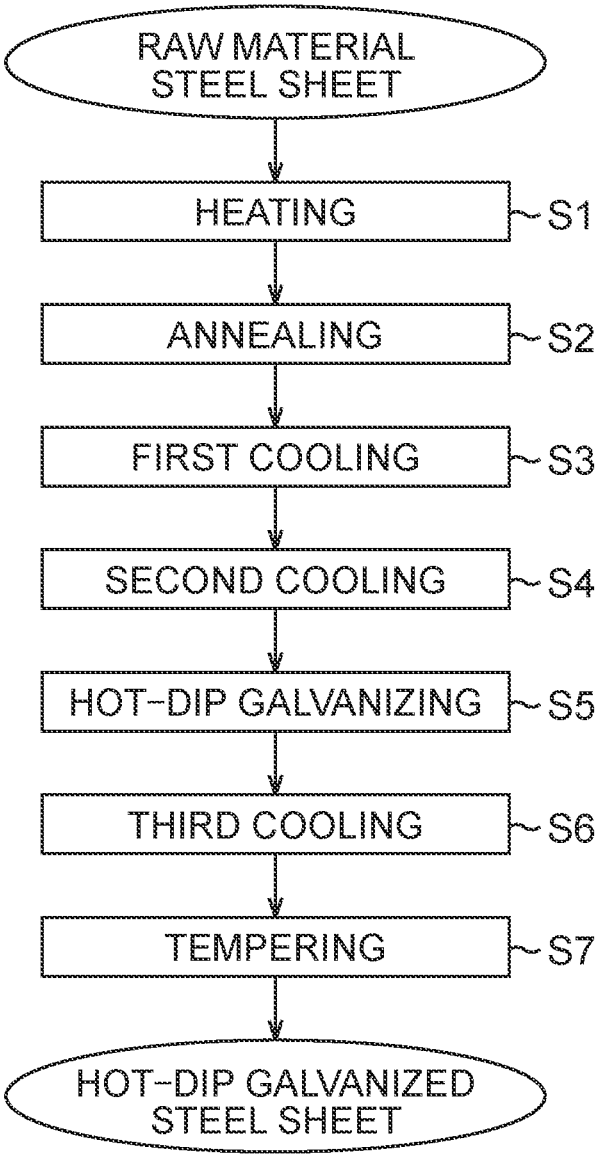
FIG. 3 is a flow chart illustrating a first example of a method of manufacturing a plated steel sheet.
Figure 4:
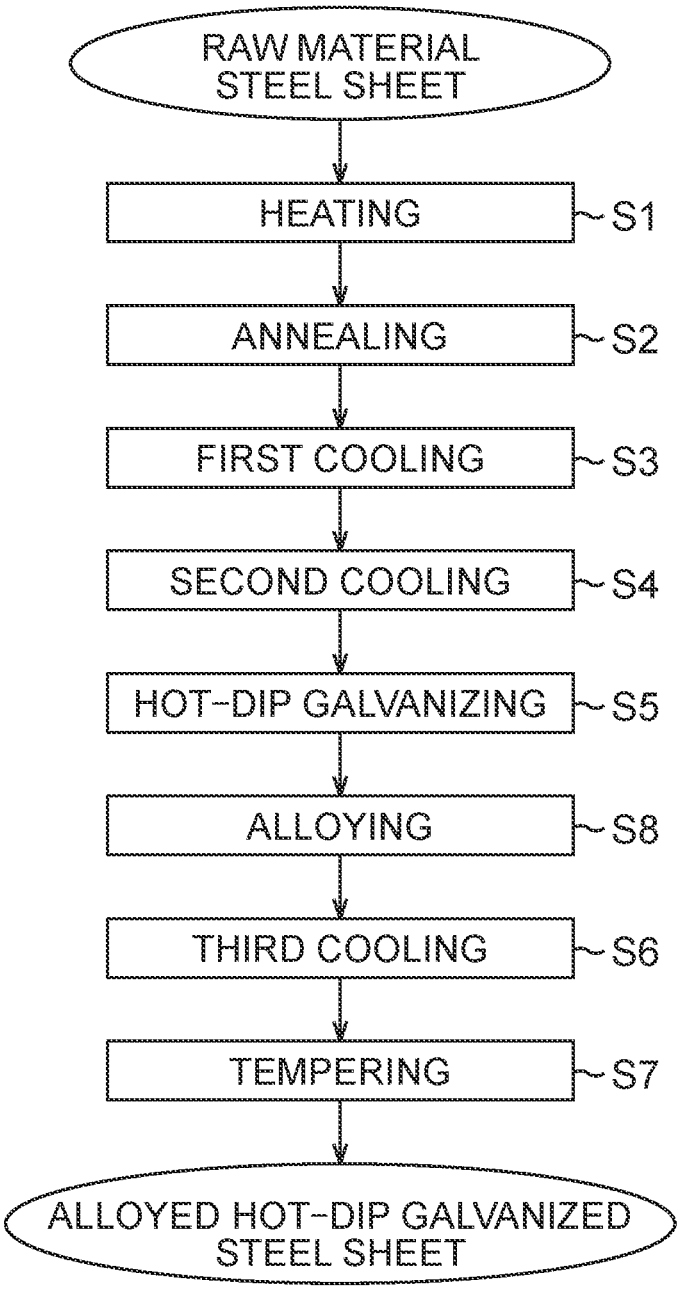
FIG. 4 is a flow chart illustrating a second example of a method of manufacturing a plated steel sheet.

Next, description will be made on examples of a method of manufacturing the plated steel sheet 1 according to the embodiment of the present invention. In a first example, heating (step S1), annealing (step S2), first cooling (step S3), second cooling (step S4), hot-dip galvanizing (step S5), third cooling (step S6), and tempering (step S7), of a raw material steel sheet, are performed in this order, as illustrated in FIG. 3. In a second example, heating (step S1), annealing (step S2), first cooling (step S3), second cooling (step S4), hot-dip galvanizing (step S5), alloying (step S8), third cooling (step S6), and tempering (step S7), of a raw material steel sheet, are performed in this order, as illustrated in FIG. 4. As the raw material steel sheet, a hot-rolled steel sheet or a cold-rolled steel sheet is used, for example.

(Heating)

In the heating (step S1) of the raw material steel sheet, an average heating rate in a temperature range of 100° C. to 720° C. is 1° C./second to 50° C./second. The average heating rate indicates a value obtained by dividing a difference between a heating start temperature and a heating finish temperature by a heating time. If the average heating rate is less than 1° C./second, cementite in the raw material steel sheet is not dissolved in the heating of the raw material steel sheet, resulting in that the tensile strength of the plated steel sheet 1 reduces. If the average heating rate is less than 1° C./second, it is difficult to disperse the tempered martensite in the decarburized ferrite layer 12, and the number density of the tempered martensite in the decarburized ferrite layer 12 becomes less than $0.01/\mu m^2$. Therefore, the average heating rate is 1° C./second or more. On the other hand, if the average heating rate exceeds 50° C./second, coarse ferrite is generated in the raw material steel sheet in the heating of the raw material steel sheet. Also, when the average heating rate exceeds 50° C./second, it is difficult to disperse the tempered martensite in the decarburized ferrite layer 12, and the number density of the tempered martensite in the decarburized ferrite layer 12 becomes less than $0.01/\mu m^2$. Therefore, the average heating rate is 50° C./second or less.

(Annealing)

In the annealing (step S2), the raw material steel sheet is held at 720° C. to 950° C. for 10 seconds to 600 seconds. The austenite is generated in the raw material steel sheet in the annealing. If an annealing temperature is less than 720° C., the austenite is not generated, and it is not possible to generate the tempered martensite after that. Therefore, the annealing temperature is 720° C. or more. In order to make the structure of the base material 13 to be a more uniformized structure to obtain further excellent bendability, the annealing temperature is preferably an $Ac_3$ point or more (austenite single-phase region). In this case, it is preferable that it takes 30 seconds or more for increasing temperature from 720° C. to the $Ac_3$ point. This is because the decarburized ferrite layer 12 having an average grain diameter of 10 μm or less can be stably generated on the surface of the raw material steel sheet. On the other hand, if the annealing temperature exceeds 950° C., it is difficult to set the number density of the tempered martensite in the decarburized ferrite layer 12 to $0.01/\mu m^2$ or more, or the austenite is grown during the annealing, resulting in that the volume fraction of ferrite in the decarburized ferrite layer becomes too small. Therefore, the annealing temperature is 950° C. or less. Note that if the holding time in the annealing is less than 10 seconds, the thickness of the decarburized ferrite layer 12 becomes less than 5 μm. Therefore, the holding time is 10 seconds or more. On the other hand, if the holding time in the annealing exceeds 600 seconds, the thickness of the decarburized ferrite layer 12 exceeds 200 μm, or the effect of annealing is saturated to lower the productivity. Therefore, the holding time is 600 seconds or less.

The annealing is performed under an atmosphere in which a hydrogen concentration is 2 volume % to 20 volume %, and a dew point is −30° C. to 20° C. If the hydrogen concentration is less than 2%, it is not possible to sufficiently reduce an oxide film on the surface of the raw material steel sheet, and it is not possible to obtain sufficient plating wettability at the time of performing the hot-dip galvanizing (step S5). Therefore, the hydrogen concentration is 2 volume % or more. On the other hand, if the hydrogen concentration is less than 20 volume %, it is not possible to maintain the dew point to 20° C. or less, resulting in that dew condensation occurs in a facility to hinder operation of the facility. Therefore, the hydrogen concentration is 20 volume % or more. If the dew point is less than −30° C., the thickness of the decarburized ferrite layer 12 becomes less than 5 μm. Therefore, the dew point is −30° C. or more. On the other hand, if the dew point exceeds 20° C., dew condensation occurs in a facility to hinder operation of the facility. Therefore, the dew point is 20° C. or less.

(First Cooling)

In the first cooling (step S3), an average cooling rate from 720° C. to 650° C. is 0.5° C./second to 10.0° C./second. The average cooling rate indicates a value obtained by dividing a difference between a cooling start temperature and a cooling finish temperature by a cooling time. In the first cooling, the martensite is generated in the decarburized ferrite layer 12, C is concentrated in non-transformed austenite, and a part or all of the martensite and the retained austenite form the M-A. If the average cooling rate is less than 0.5° C./second, cementite is precipitated in the first cooling, resulting in that it becomes difficult for the martensite to be generated in the decarburized ferrite layer 12. Therefore, the average cooling rate is 0.5° C./second or more, preferably 1.0° C./second or more, and more preferably 1.5° C./second or more. On the other hand, if the average cooling rate exceeds 10.0° C./second, C is difficult to be diffused, and thus a concentration gradient of C in the austenite is not sufficiently provided. For this reason, the retained austenite is difficult to be generated, and thus the M-A is difficult to be generated in the base material 13. Therefore, the average cooling rate is 10.0° C./second or less, preferably 8.0° C./second or less, and more preferably 6.0° C./second or less.

(Second Cooling)

In the second cooling (step S4), an average cooling rate from 650° C. to 500° C. is 2.0° C./second to 100.0° C./second. If the average cooling rate is less than 2.0° C./second, pearlite is precipitated to suppress the generation of retained austenite. Therefore, the average cooling rate is 2.0° C./second or more, preferably 5.0° C./second or more, and more preferably 8.0° C./second or more. On the other hand, if the average cooling rate exceeds 100.0° C./second, flatness of the steel sheet 10 deteriorates, and a thickness of the plating layer 11 varies greatly. Therefore, the average cooling rate is 100.0° C./second or less, preferably 60.0° C./second or less, and more preferably 40° C./second or less.

(Hot-Dip Galvanizing, Alloying)

A bath temperature and a bath composition in the hot-dip galvanizing (step S5) are not limited, and general ones may be employed. A coating weight is also not limited, and a general one may be employed. For example, the coating weight per one side is 20 $g/m^2$ to 120 $g/m^2$. When an alloyed hot-dip galvanizing layer is formed as the plating layer 11, the alloying (step S8) is performed following the hot-dip galvanizing treatment. The alloying is preferably performed under a condition in which an Fe concentration in the plating layer 11 becomes 7 mass % or more. In order to make the Fe concentration 7 mass % or more, for example, a temperature in the alloying is 490° C. to 560° C., and a period of time of the treatment is 5 seconds to 60 seconds, although depending also on the coating weight. When a hot-dip galvanizing layer is formed as the plating layer 11, the alloying is not performed. In this case, the Fe concentration in the plating layer 11 may also be less than 7 mass %. The weldability of the hot-dip galvanized steel sheet is lower than the weldability of the alloyed hot-dip galvanized steel sheet. However, the corrosion resistance of the hot-dip galvanized steel sheet is good.

It is also possible to perform isothermal holding and cooling of the raw material steel sheet, according to need, between the second cooling (step S4) and the hot-dip galvanizing treatment (step S5).

(Third Cooling)

In the third cooling (step S6), an average cooling rate from the alloying temperature in the case of performing the alloying or the bath temperature in the hot-dip galvanizing in the case of performing no alloying to a temperature of 200° C. or less is 2° C./second or more. In the third cooling, stabilized austenite is generated. Almost all of the stabilized austenite remains as it is as austenite even after being subjected to the tempering (step S7). In the third cooling, hard martensite may be generated other than the stabilized austenite, and the hard martensite is turned into the tempered martensite having ductility by being subjected to the tempering (step S7). If the average cooling rate is less than 2° C./second, it is not possible to sufficiently obtain the stabilized austenite, and the volume fraction of the retained austenite in the base material 13 becomes less than 5.0%. Therefore, the average cooling rate is 2° C./second or more, and preferably 5° C./second or more. Although an upper limit of the average cooling rate is not limited, it is preferably 500° C./second or less, from a viewpoint of economic efficiency. Although a cooling stop temperature of the third cooling is not limited, it is preferably a temperature of 100° C. or less.

(Tempering)

In the tempering (step S7), the raw material steel sheet is held at 100° C. or more and less than 200° C. for 30 seconds (0.5 minutes) to 48 hours (1152 minutes). The effect of tempering is exhibited more significantly in the decarburized ferrite layer 12 than in the base material 13. Specifically, at the tempering temperature of less than 200° C., the degree of softening of martensite in the base material 13 is low, and meanwhile, in the decarburized ferrite layer 12, the C concentration is lower than that in the base material 13, and thus surface diffusion easily occurs, which leads to significant softening. The easiness of occurrence of crack in the vicinity of the surface of the steel sheet 10 exerts a large influence on the bendability, and it is possible to appropriately reduce the hardness of the tempered martensite in the decarburized ferrite layer 12 while maintaining a high average hardness of the tempered martensite in the base material 13. Therefore, it is possible to improve the bendability and the elongation while securing high tensile strength. In addition, by performing the tempering, C is concentrated not only in the non-transformed retained austenite but also in the ferrite when the raw material steel sheet contains the ferrite. Further, because of the concentration of C, the retained austenite and the ferrite are hardened, resulting in that uniform elongation (U. El) of the plated steel sheet 1 is improved.

If the tempering temperature is less than 100° C., the tempering of martensite in the decarburized ferrite layer 12 is insufficient, and the average hardness of the tempered martensite in the decarburized ferrite layer 12 exceeds 8 GPa. Therefore, the tempering temperature is 100° C. or more, and preferably 120° C. or more. On the other hand, if the tempering temperature is 200° C. or more, the retained austenite in the base material 13 and the decarburized ferrite layer 12 is decomposed, and the average hardness of the tempered martensite in the base material 13 becomes less than 5 GPa. As a result, the tensile strength lowers, and the elongation deteriorates. Therefore, the tempering temperature is less than 200° C. If a tempering time is less than 30 seconds, the tempering of martensite in the decarburized ferrite layer 12 is insufficient, and the average hardness of the tempered martensite in the decarburized ferrite layer 12 exceeds 8 GPa. Therefore, the tempering time is 30 seconds or more. On the other hand, if the tempering time exceeds 48 hours, the effect is saturated and the productivity is unnecessarily lowered. Therefore, the tempering time is 48 hours or less. In the tempering, it is preferable to suppress temperature fluctuation to keep a certain temperature, in order to suppress variation of properties of the steel sheet 10. It is preferable that the entire martensite of the M-A in the base material 13 is tempered by the tempering.

After the tempering, it is also possible to perform correction of flatness by using a leveler, and it is also possible to perform oil coating or provide a coating film having a lubrication action.

It is possible to manufacture the plated steel sheet 1 according to the present embodiment in a manner as described above.

Although the mechanical properties of the plated steel sheet 1 are not limited, in the tensile test in which the sheet width direction is set as the tensile direction, the tensile strength (TS) is preferably 780 MPa or more, more preferably 800 MPa or more, and still more preferably 900 MPa or more.

If, in this tensile test, the tensile strength is less than 780 MPa, it is sometimes difficult to secure sufficient shock absorbency when the plated steel sheet 1 is used as automotive parts. When considering the application to the automotive parts with respect to which a high degree of strength when plastic deformation starts at a time of collision is required, the yield strength (YS) in this tensile test is preferably 420 MPa or more, and more preferably 600 MPa or more. When considering the application to the automotive parts with respect to which the formability is required, the total elongation is preferably 12% or more, and the hole expansion ratio is preferably 35% or more. In addition, regarding the bendability, it is preferable to provide characteristics such that in the 90-degree V-shaped bending test, no crack occurs and no constriction of 10 μm or more occurs.

Note that the above-described embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

EXAMPLE

Next, examples of the present invention will be described. A condition of the examples is one condition example which is adopted in order to confirm a possibility of implementation and an effect of the present invention, and the present invention is not limited to this one condition example. The present invention allows an adoption of various conditions as long as an object of the present invention is achieved without departing from the gist of the present invention.

Steels having chemical compositions presented in Table 1 were smelted in an experimental furnace to produce slabs each having a thickness of 40 mm. The balance of the chemical composition presented in Table 1 is composed of Fe and impurities. An underline in Table 1 indicates that a numeric value to which the underline is applied is out of the range of the present invention. Then, hot rolling, cooling using a water spray, and first heat treatment were performed on the slabs. In the cooling using the water spray, an average cooling rate was about 30° C./second. A finish temperature of the hot rolling, a thickness after the hot rolling (a thickness of a hot-rolled steel sheet), and a cooling stop temperature are presented in Table 2 and Table 3. In the first heat treatment, the hot-rolled steel sheet was charged into a furnace, held in the furnace at the cooling stop temperature for 60 minutes, and cooled in the furnace to 100° C. or less at a cooling rate of 20° C./hour. The cooling stop temperature is set by assuming a coiling temperature, and the first heat treatment simulates a thermal history during coiling the hot-rolled steel sheet. After the first heat treatment, a scale was removed through pickling, and cold rolling was performed. A thickness after the cold rolling (a thickness of a cold-rolled steel sheet) is presented in Table 2 and Table 3.

Thereafter, test materials for heat treatment were collected from the cold-rolled steel sheets, and heating, annealing, first cooling, second cooling, second heat treatment which simulates hot-dip galvanizing, third cooling, and tempering were performed. Some of the test materials were subjected to third heat treatment which simulates alloying between the second heat treatment and the third cooling. An average heating rate from 100° C. to 720° C. in heating each of the test materials is presented in Table 2 and Table 3. In the annealing, the test materials were held at temperatures presented in Table 2 and Table 3 for periods of time presented in Table 2 and Table 3. A dew point and a hydrogen concentration in the atmosphere at that time are presented in Table 2 and Table 3. An average cooling rate from 720° C. to 650° C. of the first cooling and an average cooling rate from 650° C. to 500° C. of the second cooling are presented in Table 4 and Table 5. Between the second cooling and the second heat treatment, the test materials were held at 460° C. to 500° C. for periods of time presented in Table 4 and Table 5, the test materials were held at 460° C. for 3 seconds in the second heat treatment, and the test materials were held at 510° C. for 3 seconds in the third heat treatment. A cooling stop temperature of the third cooling, an average cooling rate from the temperature of the third heat treatment to the cooling stop temperature regarding the test material which was subjected to the third heat treatment, and an average cooling rate from the temperature of the second heat treatment to the cooling stop temperature regarding the test material which was not subjected to the third heat treatment are presented in Table 4 and Table 5. A maximum attained temperature of the tempering and a period of time of holding at the temperature are presented in Table 4 and Table 5. A rate of heating to the maximum attained temperature was 20° C./second. An underline in Table 2 to Table 5 indicates that a numeric value to which the underline is applied is out of the desirable range.

TABLE 1

| STEEL | CHEMICAL COMPOSITION (MASS %) | | | | | | | |
|---|---|---|---|---|---|---|---|---|
| SYMBOL | C | Si | Mn | P | S | sol. Al | N | OTHERS |
| A | 0.235 | 1.46 | 2.12 | 0.005 | 0.0008 | 0.046 | 0.0022 | |
| B | 0.211 | 0.21 | 2.26 | 0.006 | 0.0011 | 0.045 | 0.0024 | |
| C | 0.188 | 1.82 | 2.53 | 0.005 | 0.0012 | 0.046 | 0.0034 | |
| D | 0.175 | 1.24 | 0.82 | 0.005 | 0.0012 | 0.047 | 0.0036 | Mo: 0.5 |
| E | 0.191 | 1.61 | 2.88 | 0.005 | 0.0011 | 0.045 | 0.0033 | Ti: 0.012 |
| F | 0.183 | 1.37 | 2.85 | 0.006 | 0.0009 | 0.048 | 0.0027 | Nb: 0.018 |
| G | 0.202 | 1.50 | 2.54 | 0.005 | 0.0008 | 0.046 | 0.0035 | Ti: 0.025, B: 0.0019 |
| H | 0.227 | 1.32 | 2.06 | 0.004 | 0.0008 | 0.045 | 0.0026 | Cu: 0.28, Ni: 0.16 |
| I | 0.177 | 1.63 | 2.51 | 0.006 | 0.0008 | 0.047 | 0.0038 | Mo: 0.17, B: 0.0015 |
| J | 0.182 | 1.65 | 2.70 | 0.005 | 0.0012 | 0.048 | 0.0031 | Cr: 0.32, Mo: 0.08 |
| K | 0.183 | 1.52 | 2.54 | 0.005 | 0.0011 | 0.047 | 0.0026 | Ca: 0.0008, Mg: 0.0007 |
| L | 0.186 | 1.60 | 2.97 | 0.006 | 0.0012 | 0.046 | 0.0029 | Bi: 0.0030, REM: 0.0005 |
| M | 0.220 | 1.47 | 2.03 | 0.004 | 0.0011 | 0.045 | 0.0032 | Ti: 0.047 |
| N | 0.299 | 1.64 | 3.07 | 0.004 | 0.0009 | 0.049 | 0.0025 | Cr: 0.55 |
| O | 0.297 | 1.67 | 2.55 | 0.004 | 0.0008 | 0.048 | 0.0023 | |
| P | 0.365 | 1.83 | 2.76 | 0.004 | 0.0008 | 0.047 | 0.0023 | |
| Q | 0.024 | 1.65 | 4.33 | 0.005 | 0.0008 | 0.043 | 0.0029 | |
| R | 0.180 | 1.31 | 2.23 | 0.013 | 0.0006 | 0.021 | 0.0046 | |
| S | 0.070 | 1.01 | 2.04 | 0.004 | 0.0006 | 0.023 | 0.0036 | |
| T | 0.062 | 0.65 | 1.57 | 0.005 | 0.0011 | 0.034 | 0.0036 | |
| U | 0.140 | 1.88 | 1.60 | 0.012 | 0.0007 | 0.036 | 0.0041 | |
| V | 0.081 | 1.16 | 2.83 | 0.011 | 0.0044 | 0.020 | 0.0019 | |
| W | 0.255 | 1.79 | 2.01 | 0.008 | 0.0014 | 0.053 | 0.0052 | Nb: 0.015 |
| X | 0.113 | 1.09 | 1.17 | 0.014 | 0.0059 | 0.069 | 0.0033 | Ni: 1.13 |
| Y | 0.130 | 1.38 | 2.50 | 0.006 | 0.0057 | 0.051 | 0.0027 | W: 0.2500 |
| Z | 0.195 | 0.27 | 2.72 | 0.011 | 0.0037 | 0.047 | 0.0027 | Ti: 0.081 |

TABLE 2

| | | HOT-ROLLING | | | COLD-ROLLING | |
|---|---|---|---|---|---|---|
| SAMPLE No. | STEEL SYMBOL | THICKNESS OF HOT-ROLLED STEEL SHEET (mm) | FINISH TEMPER-ATURE (° C.) | COILING TEMPER-ATURE (° C.) | THICKNESS OF COLD-ROLLED STEEL SHEET (mm) | HEATING AVERAGE HEATING RATE |
| 1 | A | 2.5 | 960 | 550 | 1.2 | 8 |
| 2 | A | 2.5 | 960 | 550 | 1.2 | 8 |

TABLE 2-continued

| | | | | | | |
|---|---|---|---|---|---|---|
| 3 | A | 2.5 | 960 | 550 | 1.2 | 8 |
| 4 | A | 2.5 | 960 | 550 | 1.2 | 8 |
| 5 | C | 2.5 | 940 | 600 | 1 2 | 8 |
| 6 | C | 2.5 | 940 | 600 | 1.2 | 8 |
| 7 | C | 2.5 | 940 | 600 | 1.2 | 8 |
| 8 | C | 2.5 | 940 | 600 | 1.2 | 8 |
| 9 | E | 2.5 | 940 | 600 | 1.2 | 8 |
| 10 | E | 2.5 | 940 | 600 | 1.2 | 8 |
| 11 | F | 2.5 | 940 | 600 | 1.2 | 8 |
| 12 | G | 2.5 | 950 | 600 | 1.2 | 8 |
| 13 | H | 3.0 | 950 | 550 | 1.6 | 8 |
| 14 | I | 2.5 | 960 | 550 | 1.2 | 8 |
| 15 | J | 2.5 | 940 | 600 | 1.2 | 8 |
| 16 | J | 2.5 | 940 | 600 | 1.2 | 8 |
| 17 | K | 3.0 | 960 | 600 | 1.6 | 8 |
| 18 | L | 3.0 | 940 | 600 | 1.6 | 8 |
| 19 | M | 3.0 | 950 | 550 | 1.6 | 8 |
| 20 | N | 2.5 | 950 | 640 | 1.2 | 8 |
| 21 | N | 2.5 | 950 | 640 | 1.2 | 8 |
| 22 | O | 2.5 | 940 | 640 | 1.2 | 8 |
| 23 | P | 2.5 | 940 | 640 | 1.2 | 8 |
| 24 | P | 2.5 | 940 | 640 | 1.2 | 8 |
| 25 | R | 2.5 | 880 | 530 | 1.2 | 5 |
| 26 | S | 2.5 | 910 | 520 | 1.2 | 8 |

| | ANNEALING | | | | |
|---|---|---|---|---|---|
| SAMPLE No. | TEMPER-ATURE (° C.) | TIME (s) | DEW POINT (° C.) | HYDROGEN CONCENTRATION (VOLUME %) | REMARKS |
| 1 | 820 | 30 | −10 | 4 | INVENTION EXAMPLE |
| 2 | 820 | 30 | −10 | 4 | INVENTION EXAMPLE |
| 3 | 820 | 30 | −10 | 4 | INVENTION EXAMPLE |
| 4 | 820 | 30 | −10 | 4 | INVENTION EXAMPLE |
| 5 | 840 | 30 | −10 | 4 | INVENTION EXAMPLE |
| 6 | 840 | 30 | −10 | 4 | INVENTION EXAMPLE |
| 7 | 840 | 30 | −10 | 4 | INVENTION EXAMPLE |
| 8 | 840 | 30 | −10 | 4 | INVENTION EXAMPLE |
| 9 | 840 | 30 | −10 | 4 | INVENTION EXAMPLE |
| 10 | 840 | 30 | −10 | 4 | INVENTION EXAMPLE |
| 11 | 840 | 30 | −10 | 4 | INVENTION EXAMPLE |
| 12 | 840 | 30 | −10 | 4 | INVENTION EXAMPLE |
| 13 | 820 | 30 | −10 | 4 | INVENTION EXAMPLE |
| 14 | 840 | 30 | −10 | 4 | INVENTION EXAMPLE |
| 15 | 850 | 30 | −10 | 4 | INVENTION EXAMPLE |
| 16 | 850 | 30 | −10 | 4 | INVENTION EXAMPLE |
| 17 | 840 | 30 | −10 | 4 | INVENTION EXAMPLE |
| 18 | 840 | 30 | −10 | 4 | INVENTION EXAMPLE |
| 19 | 820 | 30 | −10 | 4 | INVENTION EXAMPLE |
| 20 | 790 | 30 | −10 | 4 | INVENTION EXAMPLE |
| 21 | 790 | 30 | −10 | 4 | INVENTION EXAMPLE |
| 22 | 780 | 30 | −10 | 4 | INVENTION EXAMPLE |
| 23 | 780 | 30 | −10 | 4 | INVENTION EXAMPLE |
| 24 | 820 | 30 | −10 | 4 | INVENTION EXAMPLE |
| 25 | 860 | 50 | −10 | 4 | INVENTION EXAMPLE |
| 26 | 830 | 50 | −10 | 4 | INVENTION EXAMPLE |

TABLE 3

| | | HOT-ROLLING | | | COLD-ROLLING | |
|---|---|---|---|---|---|---|
| SAMPLE No. | STEEL SYMBOL | THICKNESS OF HOT-ROLLED STEEL SHEET (mm) | FINISH TEMPER-ATURE (° C.) | COILING TEMPER-ATURE (° C.) | THICKNESS OF CCLD-ROLLED STEEL SHEET (mm) | HEATING AVERAGE HEATING RATE |
| 27 | A | 2.5 | 960 | 550 | 1.2 | 8 |
| 28 | A | 2.5 | 960 | 550 | 1.2 | 8 |
| 29 | A | 2.5 | 960 | 550 | 1.2 | 8 |
| 30 | A | 2.5 | 960 | 550 | 1.2 | 8 |
| 31 | A | 2.5 | 960 | 550 | 1.2 | 8 |
| 32 | A | 2.5 | 960 | 550 | 1.2 | 8 |
| 33 | A | 2.5 | 960 | 550 | 1.2 | 8 |
| 34 | B | 3.0 | 900 | 500 | 1.6 | 8 |
| 35 | C | 2.5 | 940 | 600 | 1.2 | 8 |
| 36 | D | 3.0 | 960 | 680 | 1.6 | 8 |

TABLE 3-continued

| | | | | | | |
|---|---|---|---|---|---|---|
| 37 | E | 2.5 | 940 | 600 | 1.2 | 8 |
| 38 | F | 2.5 | 940 | 600 | 1.2 | 8 |
| 39 | Q | 2.5 | 940 | 640 | 1.2 | 8 |
| 40 | R | 2.5 | 870 | 580 | 1.2 | 8 |
| 41 | R | 2.5 | 890 | 670 | 1.2 | 60 |
| 42 | R | 2.5 | 890 | 520 | 1.2 | 8 |
| 43 | R | 2.5 | 890 | 520 | 1.2 | 8 |
| 44 | R | 2.5 | 880 | 530 | 1.2 | 8 |
| 45 | S | 2.5 | 980 | 700 | 1.2 | 8 |
| 46 | S | 2.5 | 890 | 520 | 1.2 | 0.2 |
| 47 | N | 2.5 | 920 | 570 | 1.2 | 8 |
| 48 | T | 2.5 | 940 | 560 | 1.2 | 8 |
| 49 | U | 2.5 | 90 | 500 | 1.2 | 8 |
| 50 | V | 2.5 | 903 | 670 | 1.2 | 5.3 |
| 51 | W | 2.5 | 947 | 660 | 1.2 | 5.3 |
| 52 | X | 2.5 | 960 | 640 | 1.2 | 5.4 |
| 53 | Y | 2.5 | 932 | 680 | 1.2 | 11.4 |
| 54 | Z | 2.5 | 950 | 690 | 1.2 | 3.9 |

| | ANNEALING | | | | |
|---|---|---|---|---|---|
| SAMPLE No. | TEMPER-ATURE (° C.) | TIME (s) | DEW POINT (° C.) | HYDROGEN CONCENTRATION (VOLUME %) | REMARKS |
| 27 | 820 | 30 | −10 | 4 | COMPARATIVE EXAMPLE |
| 28 | 800 | 30 | −10 | 4 | COMPARATIVE EXAMPLE |
| 29 | 700 | 30 | −10 | 4 | COMPARATIVE EXAMPLE |
| 30 | 820 | 30 | −10 | 4 | COMPARATIVE EXAMPLE |
| 31 | 820 | 30 | −10 | 4 | COMPARATIVE EXAMPLE |
| 32 | 820 | 30 | −10 | 4 | COMPARATIVE EXAMPLE |
| 33 | 820 | 30 | −10 | 4 | COMPARATIVE EXAMPLE |
| 34 | 880 | 30 | −10 | 4 | COMPARATIVE EXAMPLE |
| 35 | 840 | 30 | −10 | 4 | COMPARATIVE EXAMPLE |
| 36 | 840 | 30 | −10 | 4 | COMPARATIVE EXAMPLE |
| 37 | 970 | 30 | −10 | 4 | COMPARATIVE EXAMPLE |
| 38 | 840 | 30 | −10 | 4 | COMPARATIVE EXAMPLE |
| 39 | 820 | 30 | −10 | 4 | COMPARATIVE EXAMPLE |
| 40 | 870 | 70 | −5 | 3 | COMPARATIVE EXAMPLE |
| 41 | 849 | 80 | 0 | 2 | COMPARATIVE EXAMPLE |
| 42 | 860 | 70 | −45 | 4 | COMPARATIVE EXAMPLE |
| 43 | 860 | 3 | −20 | 4 | COMPARATIVE EXAMPLE |
| 44 | 860 | 50 | −10 | 4 | COMPARATIVE EXAMPLE |
| 45 | 800 | 1000 | −10 | 4 | COMPARATIVE EXAMPLE |
| 46 | 780 | 50 | −10 | 4 | COMPARATIVE EXAMPLE |
| 47 | 790 | 30 | −10 | 4 | COMPARATIVE EXAMPLE |
| 48 | 880 | 80 | −10 | 4 | COMPARATIVE EXAMPLE |
| 49 | 760 | 80 | −10 | 4 | COMPARATIVE EXAMPLE |
| 50 | 824 | 30 | −10 | 4 | COMPARATIVE EXAMPLE |
| 51 | 877 | 30 | −10 | 4 | COMPARATIVE EXAMPLE |
| 52 | 857 | 30 | −10 | 4 | COMPARATIVE EXAMPLE |
| 53 | 763 | 30 | −10 | 4 | COMPARATIVE EXAMPLE |
| 54 | 883 | 30 | −10 | 4 | COMPARATIVE EXAMPLE |

TABLE 4

| SAMPLE No. | STEEL SYMBOL | FIRST COOLING AVERAGE COOLING RATE (° C./s) | SECOND COOLING AVERAGE COOLING RATE (° C./s) | SECOND THERMAL TREATMENT (HOT-DIP GALVANIZING) TIME (s) | THIRD THERMAL TREATMENT (ALLOYING) | THIRD COOLING AVERAGE COOLING RATE (° C./s) |
|---|---|---|---|---|---|---|
| 1 | A | 5 | 30 | 24 | WITH | 12 |
| 2 | A | 5 | 30 | 24 | WITH | 12 |
| 3 | A | 5 | 30 | 24 | WITHOUT | 12 |
| 4 | A | 5 | 30 | 78 | WITH | 12 |
| 5 | C | 2 | 4 | 19 | WITH | 14 |
| 6 | C | 2 | 4 | 19 | WITHOUT | 14 |
| 7 | C | 2 | 4 | 19 | WITH | 14 |
| 8 | C | 2 | 4 | 19 | WITH | 14 |
| 9 | E | 5 | 30 | 24 | WITH | 12 |
| 10 | E | 5 | 30 | 24 | WITH | 12 |
| 11 | F | 2 | 4 | 19 | WITH | 14 |
| 12 | G | 2 | 4 | 19 | WITH | 14 |
| 13 | H | 5 | 30 | 24 | WITHOUT | 14 |

TABLE 4-continued

| | | | | | | |
|---|---|---|---|---|---|---|
| 14 | I | 5 | 30 | 24 | WITH | 12 |
| 15 | J | 2 | 4 | 19 | WITH | 14 |
| 16 | J | 10 | 10 | 14 | WITHOUT | 14 |
| 17 | K | 2 | 4 | 19 | WITH | 14 |
| 18 | L | 2 | 4 | 19 | WITH | 14 |
| 19 | M | 5 | 30 | 24 | WITH | 12 |
| 20 | N | 2 | 4 | 19 | WITH | 14 |
| 21 | N | 2 | 4 | 19 | WITHOUT | 14 |
| 22 | O | 2 | 4 | 19 | WITH | 14 |
| 23 | P | 2 | 4 | 19 | WITH | 14 |
| 24 | P | 2 | 4 | 19 | WITH | 14 |
| 25 | R | 5 | 30 | 20 | WITH | 12 |
| 26 | S | 5 | 30 | 20 | WITH | 12 |

| SAMPLE No. | THIRD COOLING STOP TEMPERATURE (s) | TEMPERING TEMPERATURE (° C.) | TEMPERING TIME (s) | REMARKS |
|---|---|---|---|---|
| 1 | ROOM TEMPERATURE | 190 | 15 | INVENTION EXAMPLE |
| 2 | ROOM TEMPERATURE | 140 | 1000 | INVENTION EXAMPLE |
| 3 | ROOM TEMPERATURE | 190 | 3 | INVENTION EXAMPLE |
| 4 | ROOM TEMPERATURE | 180 | 60 | INVENTION EXAMPLE |
| 5 | ROOM TEMPERATURE | 190 | 80 | INVENTION EXAMPLE |
| 6 | ROOM TEMPERATURE | 190 | 360 | INVENTION EXAMPLE |
| 7 | ROOM TEMPERATURE | 180 | 250 | INVENTION EXAMPLE |
| 8 | 100 | 190 | 200 | INVENTION EXAMPLE |
| 9 | ROOM TEMPERATURE | 190 | 200 | INVENTION EXAMPLE |
| 10 | ROOM TEMPERATURE | 150 | 100 | INVENTION EXAMPLE |
| 11 | ROOM TEMPERATURE | 190 | 1.5 | INVENTION EXAMPLE |
| 12 | ROOM TEMPERATURE | 190 | 24 | INVENTION EXAMPLE |
| 13 | ROOM TEMPERATURE | 170 | 100 | INVENTION EXAMPLE |
| 14 | ROOM TEMPERATURE | 160 | 300 | INVENTION EXAMPLE |
| 15 | ROOM TEMPERATURE | 150 | 200 | INVENTION EXAMPLE |
| 16 | ROOM TEMPERATURE | 160 | 400 | INVENTION EXAMPLE |
| 17 | ROOM TEMPERATURE | 190 | 200 | INVENTION EXAMPLE |
| 18 | ROOM TEMPERATURE | 190 | 30 | INVENTION EXAMPLE |
| 19 | ROOM TEMPERATURE | 190 | 50 | INVENTION EXAMPLE |
| 20 | ROOM TEMPERATURE | 180 | 180 | INVENTION EXAMPLE |
| 21 | ROOM TEMPERATURE | 180 | 60 | INVENTION EXAMPLE |
| 22 | ROOM TEMPERATURE | 190 | 300 | INVENTION EXAMPLE |
| 23 | ROOM TEMPERATURE | 180 | 200 | INVENTION EXAMPLE |
| 24 | 100 | 190 | 40 | INVENTION EXAMPLE |
| 25 | ROOM TEMPERATURE | 130 | 800 | INVENTION EXAMPLE |
| 26 | ROOM TEMPERATURE | 120 | 900 | INVENTION EXAMPLE |

TABLE 5

| SAMPLE No. | STEEL SYMBOL | FIRST COOLING AVERAGE COOLING RATE (° C./s) | SECOND COOLING AVERAGE COOLING RATE (° C./s) | SECOND THERMAL TREATMENT (HOT-DIP GALVANIZING) TIME (s) | THIRD THERMAL TREATMENT (ALLOYING) | THIRD COOLING AVERAGE COOLING RATE (° C./s) |
|---|---|---|---|---|---|---|
| 27 | A | 5 | 30 | 24 | WITH | 12 |
| 28 | A | 5 | 30 | 24 | WITH | 12 |
| 29 | A | 5 *1 | 30 | 24 | WITH | 12 |
| 30 | A | 0.2 | 30 | 12 | WITH | 12 |
| 31 | A | 5 | 1 | 24 | WITH | 12 |
| 32 | A | 5 | 30 | 24 | WITH | 1 |
| 33 | A | 5 | 30 | 24 | WITH | 12 |
| 34 | B | 2 | 4 | 19 | WITH | 14 |
| 35 | C | 2 | 4 | 19 | WITH | 14 |
| 36 | D | 2 | 4 | 19 | WITH | 14 |
| 37 | E | 5 | 30 | 24 | WITH | 12 |
| 38 | F | 2 | 4 | 19 | WITH | 14 |
| 39 | Q | 2 | 4 | 19 | WITH | 14 |
| 40 | R | 5 | 30 | 20 | WITH | 12 |
| 41 | R | 5 | 30 | 20 | WITH | 12 |
| 42 | R | 5 | 30 | 20 | WITH | 12 |
| 43 | R | 5 | 30 | 20 | WITH | 12 |
| 44 | R | 20 | 30 | 3 | WITHOUT | 20 |

TABLE 5-continued

| | | | | | | |
|---|---|---|---|---|---|---|
| 45 | S | 5 | 30 | 20 | WITH | 12 |
| 46 | S | 5 | 30 | 20 | WITH | 12 |
| 47 | N | 2 | 4 | 19 | WITH | 14 |
| 48 | T | 2 | 30 | 20 | WITHOUT | 14 |
| 49 | U | 2 | 30 | 15 | WITHOUT | WITHOUT |
| 50 | V | 4.3 | 13.5 | 24 | WITH | 4.1 |
| 51 | W | 3.7 | 12.8 | 24 | WITHOUT | 3.5 |
| 52 | X | 3.4 | 6.2 | 24 | WITH | 53.8 |
| 53 | Y | 6.2 | 19 | 24 | WITHOUT | 1.5 |
| 54 | Z | 2.5 | 118.7 | 24 | WITH | 42.3 |

| SAMPLE No. | THIRD COOLING STOP TEMPERATURE (s) | TEMPERING TEMPERATURE (° C.) | TEMPERING TIME (s) | REMARKS |
|---|---|---|---|---|
| 27 | ROOM TEMPERATURE | 80 | 100 | COMPARATIVE EXAMPLE |
| 28 | ROOM TEMPERATURE | 520 | 1000 | COMPARATIVE EXAMPLE |
| 29 | ROOM TEMPERATURE | 180 | 30 | COMPARATIVE EXAMPLE |
| 30 | ROOM TEMPERATURE | 190 | 60 | COMPARATIVE EXAMPLE |
| 31 | ROOM TEMPERATURE | 180 | 100 | COMPARATIVE EXAMPLE |
| 32 | ROOM TEMPERATURE | 170 | 80 | COMPARATIVE EXAMPLE |
| 33 | ROOM TEMPERATURE | NOT PERFORMED | | COMPARATIVE EXAMPLE |
| 34 | ROOM TEMPERATURE | 180 | 100 | COMPARATIVE EXAMPLE |
| 35 | ROOM TEMPERATURE | NOT PERFORMED | | COMPARATIVE EXAMPLE |
| 36 | ROOM TEMPERATURE | 180 | 200 | COMPARATIVE EXAMPLE |
| 37 | ROOM TEMPERATURE | 190 | 600 | COMPARATIVE EXAMPLE |
| 39 | ROOM TEMPERATURE | 220 | 600 | COMPARATIVE EXAMPLE |
| 36 | ROOM TEMPERATURE | 180 | 100 | COMPARATIVE EXAMPLE |
| 40 | ROOM TEMPERATURE | NOT PERFORMED | | COMPARATIVE EXAMPLE |
| 41 | ROOM TEMPERATURE | 190 | 360 | COMPARATIVE EXAMPLE |
| 42 | ROOM TEMPERATURE | 170 | 200 | COMPARATIVE EXAMPLE |
| 43 | ROOM TEMPERATURE | 180 | 200 | COMPARATIVE EXAMPLE |
| 44 | ROOM TEMPERATURE | 190 | 240 | COMPARATIVE EXAMPLE |
| 45 | ROOM TEMPERATURE | 180 | 100 | COMPARATIVE EXAMPLE |
| 46 | ROOM TEMPERATURE | 190 | 80 | COMPARATIVE EXAMPLE |
| 47 | ROOM TEMPERATURE | 90 | 180 | COMPARATIVE EXAMPLE |
| 48 | ROOM TEMPERATURE | 210 | 200 | COMPARATIVE EXAMPLE |
| 49 | ROOM TEMPERATURE | 140 | 0.2 | COMPARATIVE EXAMPLE |
| 50 | ROOM TEMPERATURE | 290 | 500 | COMPARATIVE EXAMPLE |
| 51 | ROOM TEMPERATURE | 410 | 500 | COMPARATIVE EXAMPLE |
| 52 | ROOM TEMPERATURE | 250 | 500 | COMPARATIVE EXAMPLE |
| 53 | ROOM TEMPERATURE | 330 | 500 | COMPARATIVE EXAMPLE |
| 54 | ROOM TEMPERATURE | 340 | 500 | COMPARATIVE EXAMPLE |

*[1] REFERENCIAL VALUE (COOLING START POINT WAS 700° C.)

Then, a structure of each of the test materials was observed, and a tensile test and a bending test were performed on each of the test materials.

It is important whether or not the martensite is tempered, and in this determination, a cross section of each of the test materials was subjected to nital corrosion, and observed with a scanning electron microscope (SEM). Further, it was determined that the martensite was tempered in the test material having a carbide, and the martensite was not tempered in the test material having no carbide.

In the observation of the structure of the base material, image analysis of electron microscope observation images of a cross section perpendicular to a rolling direction and a cross section perpendicular to a sheet width direction (a direction perpendicular to the rolling direction) was performed, and a volume fraction of M-A at a ¼ sheet thickness position in each of the cross sections was measured. Further, an average value of the volume fractions was defined as a volume fraction of the M-A of the base material in the test material. Further, volume fractions of retained austenite in the above-described two cross sections were measured through X-ray diffraction, and an average value of the volume fractions was defined as a volume fraction of the retained austenite of the base material. Furthermore, a value obtained by subtracting the volume fraction of the retained austenite from the volume fraction of the M-A was defined as a volume fraction of the tempered martensite. In addition, an average hardness of the tempered martensite was measured by the nano-indentation method. In this measurement, an indenter having a shape of cube corner was used, and an indentation load was 500 μN. Results thereof are presented in Table 6 and Table 7. Note that the volume fraction of ferrite of the base material in each of the samples was 4.0% or more.

In the observation of the decarburized ferrite layer, an area ratio of ferrite was measured at intervals of 1 μm from the surface of each of the test materials, and a position at which the measurement value indicated 120% of the volume fraction of ferrite of the base material at the ¼ sheet thickness position was defined as an interface between the decarburized ferrite layer and the base material. Further, a distance from the surface of the test material to the interface was defined as a thickness of the decarburized ferrite layer at the cross section. The observation as described above was performed on the above-described two cross sections, and an average value in the observation was defined as a thickness of the decarburized ferrite layer in the test material. Further, by the aforementioned image analysis, a grain diameter of ferrite, a volume fraction of the tempered martensite, and a number density of the tempered martensite were calculated. Also in this calculation, an average value of the above-described two cross sections was determined. In addition, an average hardness of the tempered martensite was measured by the nano-indentation method. In this measurement, an indenter having a shape of cube corner was used, and an indentation load was 500 ρN. Results thereof are presented in Table 6 and Table 7. An underline in Table 6 and Table 7 indicates that a numeric value to which the underline is applied is out of the range of the present invention.

In the tensile test, a JIS No. 5 tensile test piece was collected from each of the test materials so that the sheet width direction (the direction perpendicular to the rolling direction) corresponded to the tensile direction, and the yield strength (YS), the tensile strength (TS), and the total elongation (T. El) were measured. In the bending test, the 90-degree V-shaped bending test with a bend radius corresponding to twice the sheet thickness was conducted, in which the test piece with no crack and no constriction of 10 μm or more was determined as "good", and the test piece other than the above was determined as "poor." Results thereof are presented in Table 6 and Table 7. An underline in Table 6 and Table 7 indicates that an item to which the underline is applied is out of the desirable range.

TABLE 6

| | | DECARBURIZED FERRITE LAYER | | | | | | BASE MATERIAL |
|---|---|---|---|---|---|---|---|---|
| | | | FERRITE | | TEMPERED MARTENSITE | | | VOLUME |
| SAMPLE No. | STEEL SYMBOL | THICK-NESS (μm) | VOLUME FRACTION (%) | AVERAGE GRAIN DIAMETER (μm) | VOLUME FRACTION (%) | NUMBER DENSITY (/μm$^2$) | AVERAGE HARDNESS (GPa) | FRACTION OF RETAINED AUSTENITE (%) |
| 1 | A | 9 | 66.4 | 4 | 11.2 | 0.081 | 6.3 | 13.1 |
| 2 | A | 8 | 74.2 | 5 | 9.3 | 0.054 | 5.4 | 10.2 |
| 3 | A | 9 | 77.4 | 6 | 10.4 | 0.036 | 6.5 | 13.2 |
| 4 | A | 13 | 68.5 | 5 | 10.3 | 0.052 | 5.7 | 12.2 |
| 5 | C | 13 | 56.8 | 4 | 23.0 | 0.081 | 5.8 | 8.3 |
| 6 | C | 9 | 70.3 | 6 | 21.3 | 0.036 | 5.4 | 8.0 |
| 7 | C | 11 | 69.5 | 6 | 16.4 | 0.036 | 5.6 | 6.5 |
| 8 | C | 9 | 72.5 | 5 | 22.1 | 0.052 | 5.4 | 12.4 |
| 9 | E | 11 | 63.8 | 5 | 24.3 | 0.052 | 5.3 | 9.2 |
| 10 | E | 9 | 72.1 | 6 | 8.3 | 0.036 | 6.4 | 10.6 |
| 11 | F | 10 | 65.6 | 7 | 25.1 | 0.027 | 6.2 | 10.3 |
| 12 | G | 10 | 60.7 | 5 | 23.1 | 0.052 | 6.2 | 9.7 |
| 13 | H | 11 | 74.1 | 6 | 10.3 | 0.036 | 6.1 | 13.3 |
| 14 | I | 9 | 64.7 | 3 | 22.8 | 0.144 | 5.9 | 8.7 |
| 15 | J | 11 | 60.3 | 8 | 23.5 | 0.020 | 6.3 | 11.1 |
| 16 | J | 12 | 54.2 | 5 | 30.9 | 0.052 | 6.1 | 11.9 |
| 17 | K | 8 | 60.1 | 8 | 22.4 | 0.020 | 5.9 | 8.1 |
| 18 | L | 11 | 61.3 | 4 | 22.7 | 0.081 | 6.4 | 8.8 |
| 19 | M | 14 | 70.5 | 7 | 10.7 | 0.027 | 5.8 | 12.9 |
| 20 | N | 9 | 57.5 | 8 | 24.5 | 0.020 | 5.6 | 14.7 |
| 21 | N | 12 | 52.4 | 3 | 28.3 | 0.144 | 6.1 | 16.7 |
| 22 | O | 10 | 68.1 | 5 | 13.7 | 0.052 | 5.8 | 15.5 |
| 23 | P | 8 | 55.7 | 7 | 22.4 | 0.027 | 6.4 | 16.8 |
| 24 | P | 10 | 54.6 | 8 | 28.4 | 0.020 | 6.2 | 22.5 |
| 25 | R | 12 | 84.3 | 8 | 4.2 | 0.020 | 5.8 | 11.2 |
| 26 | S | 13 | 77.9 | 12 | 12.0 | 0.016 | 6.3 | 5.4 |

| | BASE MATERIAL TEMPERED | | MECHANICAL PROPERTY | | | | |
|---|---|---|---|---|---|---|---|
| SAMPLE No. | VOLUME FRACTION (%) | AVERAGE HARDNESS (GPa) | YS (MPa) | TS (MPa) | T. El (%) | BEND-ABILITY | REMARKS |
| 1 | 13.8 | 8.3 | 640 | 1055 | 21.2 | GOOD | INVENTION EXAMPLE |
| 2 | 13.5 | 7.9 | 626 | 1024 | 23.5 | GOOD | INVENTION EXAMPLE |
| 3 | 13.2 | 8.4 | 646 | 1057 | 21.7 | GOOD | INVENTION EXAMPLE |
| 4 | 12.6 | 8.2 | 617 | 1029 | 22.5 | GOOD | INVENTION EXAMPLE |
| 5 | 49.4 | 8.8 | 913 | 1275 | 14.8 | GOOD | INVENTION EXAMPLE |
| 6 | 49.5 | 8.5 | 933 | 1246 | 14.3 | GOOD | INVENTION EXAMPLE |
| 7 | 49.0 | 8.4 | 921 | 1291 | 14.9 | GOOD | INVENTION EXAMPLE |
| 8 | 43.5 | 8.2 | 816 | 1203 | 16.7 | GOOD | INVENTION EXAMPLE |
| 9 | 54.8 | 8.5 | 948 | 1262 | 15.2 | GOOD | INVENTION EXAMPLE |
| 10 | 45.5 | 9.2 | 774 | 1412 | 14.5 | GOOD | INVENTION EXAMPLE |
| 11 | 52.7 | 8.5 | 890 | 1256 | 15.8 | GOOD | INVENTION EXAMPLE |
| 12 | 56.0 | 8.7 | 913 | 1228 | 16.4 | GOOD | INVENTION EXAMPLE |
| 13 | 14.9 | 7.9 | 645 | 1046 | 24.2 | GOOD | INVENTION EXAMPLE |
| 14 | 49.0 | 8.5 | 891 | 1238 | 15.8 | GOOD | INVENTION EXAMPLE |
| 15 | 60.2 | 8.6 | 1012 | 1336 | 15.2 | GOOD | INVENTION EXAMPLE |
| 16 | 65.4 | 8.7 | 1033 | 1343 | 14.5 | GOOD | INVENTION EXAMPLE |

TABLE 6-continued

| | | | | | | | |
|---|---|---|---|---|---|---|---|
| 17 | 65.1 | 7.9 | 875 | 1219 | 16.1 | GOOD | INVENTION EXAMPLE |
| 18 | 54.3 | 8.6 | 884 | 1273 | 15.4 | GOOD | INVENTION EXAMPLE |
| 19 | 13.8 | 7.8 | 629 | 1043 | 23.2 | GOOD | INVENTION EXAMPLE |
| 20 | 57.2 | 9.3 | 1143 | 1548 | 14.8 | GOOD | INVENTION EXAMPLE |
| 21 | 57.4 | 8.3 | 1120 | 1486 | 14.4 | GOOD | INVENTION EXAMPLE |
| 22 | 55.8 | 8.7 | 1150 | 1481 | 15.1 | GOOD | INVENTION EXAMPLE |
| 23 | 57.0 | 8.4 | 1146 | 1536 | 15.7 | GOOD | INVENTION EXAMPLE |
| 24 | 55.9 | 8.5 | 1072 | 1532 | 15.4 | GOOD | INVENTION EXAMPLE |
| 25 | 5.3 | 7.5 | 650 | 1091 | 20.7 | GOOD | INVENTION EXAMPLE |
| 26 | 8.3 | 8.2 | 531 | 846 | 34.1 | GOOD | INVENTION EXAMPLE |

TABLE 7

| | | DECARBURIZED FERRITE LAYER | | | | | | BASE MATERIAL |
|---|---|---|---|---|---|---|---|---|
| | | | FERRITE | | TEMPERED MARTENSITE | | | VOLUME |
| SAMPLE No. | STEEL SYMBOL | THICK-NESS (μm) | VOLUME FRACTION (%) | AVERAGE GRAIN DIAMETER (μm) | VOLUME FRACTION (%) | NUMBER DENSITY (/μm$^2$) | AVERAGE HARDNESS (GPa) | FRACTION OF RETAINED AUSTENITE (%) |
| 27 | A | 9 | 64.5 | 6 | NONE | | 9.5 *1 | 15.0 |
| 28 | A | 10 | 63.0 | 6 | 7.2 | 0.036 | 3.6 | 4.3 |
| 29 | A | 9 | 94.2 | 7 | | NONE | | NONE |
| 30 | A | 11 | 84.4 | 4 | 0.8 | 0.023 | 6.3 | 12.5 |
| 31 | A | 12 | 80.2 | 6 | 3.2 | 0.036 | 6.1 | 4.3 |
| 32 | A | 10 | 76.5 | 8 | 6.1 | 0.019 | 5.4 | 4.6 |
| 33 | A | 11 | 69.9 | 6 | NONE | | 9.8 *1 | 15.3 |
| 34 | B | 12 | 82.4 | 8 | 11.1 | 0.023 | 6.4 | 1.0 |
| 35 | C | 10 | 71.5 | 6 | NONE | | 8.9 *1 | 9.4 |
| 36 | D | 19 | 80.9 | 9 | 0.6 | 0.015 | 7.4 | 6.6 |
| 37 | E | 17 | 66.3 | 8 | 1.5 | 0.004 | 6.4 | 10.6 |
| 38 | F | 9 | 60.6 | 6 | 22.4 | 0.036 | 4.3 | 4.8 |
| 39 | Q | 9 | 62.8 | 4 | 24.5 | 0.081 | 5.6 | 9.4 |
| 40 | R | 9 | 64.1 | 10 | NONE | | 10.3 *1 | 10.3 |
| 41 | R | 45 | 80.5 | 24 | 1.6 | 0.002 | 6.2 | 9.7 |
| 42 | R | 0 | | | NONE | | | 11.4 |
| 43 | R | 0 | | | NONE | | | 10.3 |
| 44 | R | 8 | 68.2 | 11 | 3.6 | 0.015 | 6.5 | 3.7 |
| 45 | S | 220 | 73.1 | 18 | 25.6 | 0.021 | 6.2 | 6.1 |
| 48 | S | 13 | 80.7 | 12 | 3.4 | 0.004 | 6.1 | 5.3 |
| 47 | N | 13 | 63.2 | 8 | 22.3 | 0.020 | 9.4 | 14.7 |
| 48 | T | 15 | 48.8 | 6 | 43.2 | 0.025 | 3.8 | 5.2 |
| 49 | U | 14 | 67.4 | 8 | 13.5 | 0.021 | 8.7 | 6.3 |
| 50 | V | 9 | 80.2 | 6 | 3.8 | 0.032 | 4.2 | 0 |
| 51 | W | 10 | 63.4 | 5 | 24.3 | 0.042 | 6.3 | 1 |
| 52 | X | 9 | 68.5 | 7 | 11.6 | 0.022 | 4.5 | 2 |
| 53 | Y | 8 | 67.1 | 6 | 14.7 | 0.027 | 4.8 | 1 |
| 54 | Z | 9 | 73.1 | 5 | 8.5 | 0.039 | 5.3 | 0 |

| | BASE MATERIAL TEMPERED | | MECHANICAL PROPERTY | | | | |
|---|---|---|---|---|---|---|---|
| SAMPLE No. | VOLUME FRACTION (%) | AVERAGE HARDNESS (GPa) | YS (MPa) | TS (MPa) | T. El (%) | BEND-ABILITY | REMARKS |
| 27 | NONE | 10.2 *2 | 514 | 1103 | 14.8 | POOR | COMPARATIVE EXAMPLE |
| 28 | 13.7 | 4.3 | 672 | 776 | 11.2 | GOOD | COMPARATIVE EXAMPLE |
| 29 | NONE | NONE | 472 | 791 | 11.7 | POOR | COMPARATIVE EXAMPLE |
| 30 | 15.2 | 8.2 | 631 | 1142 | 14.6 | POOR | COMPARATIVE EXAMPLE |
| 31 | 3.9 | 8.4 | 450 | 971 | 11.0 | GOOD | COMPARATIVE EXAMPLE |
| 32 | 10.5 | 8.0 | 506 | 1006 | 11.6 | GOOD | COMPARATIVE EXAMPLE |
| 33 | NONE | 10.3 *2 | 503 | 1125 | 14.2 | POOR | COMPARATIVE EXAMPLE |
| 34 | 82.1 | 7.6 | 753 | 1035 | 10.9 | GOOD | COMPARATIVE EXAMPLE |
| 35 | NONE | 10.2 *2 | 695 | 1391 | 11.8 | POOR | COMPARATIVE EXAMPLE |
| 36 | 15.1 | 8.2 | 842 | 1025 | 14.7 | POOR | COMPARATIVE EXAMPLE |
| 37 | 43.9 | 9.7 | 758 | 1402 | 13.0 | POOR | COMPARATIVE EXAMPLE |
| 38 | 52.9 | 4.6 | 651 | 1175 | 11.2 | GOOD | COMPARATIVE EXAMPLE |
| 39 | 44.3 | 6.5 | 509 | 721 | 22.9 | GOOD | COMPARATIVE EXAMPLE |
| 40 | NONE | 10.4 *2 | 516 | 1139 | 18.2 | POOR | COMPARATIVE EXAMPLE |
| 41 | 4.6 | 8.1 | 764 | 1145 | 16.5 | POOR | COMPARATIVE EXAMPLE |
| 42 | 4.8 | 8.4 | 725 | 1132 | 17.8 | POOR | COMPARATIVE EXAMPLE |
| 43 | 5.2 | 8.2 | 695 | 1073 | 16.4 | POOR | COMPARATIVE EXAMPLE |

TABLE 7-continued

| | | | | | | | |
|---|---|---|---|---|---|---|---|
| 44 | 6.4 | 7.9 | 883 | 1082 | 11.2 | GOOD | COMPARATIVE EXAMPLE |
| 45 | 32.4 | 6.8 | 575 | 772 | 23.2 | GOOD | COMPARATIVE EXAMPLE |
| 48 | 8.3 | 7.1 | 626 | 764 | 33.2 | POOR | COMPARATIVE EXAMPLE |
| 47 | 59.4 | 9.7 | 895 | 1572 | 13.5 | POOR | COMPARATIVE EXAMPLE |
| 48 | 64.3 | 4.2 | 702 | 775 | 13.6 | GOOD | COMPARATIVE EXAMPLE |
| 49 | 14.2 | 10.8 | 465 | 825 | 25.2 | POOR | COMPARATIVE EXAMPLE |
| 50 | 5.2 | 4.7 | 712 | 796 | 11.3 | GOOD | COMPARATIVE EXAMPLE |
| 51 | 37.6 | 6.5 | 1053 | 1162 | 10.4 | GOOD | COMPARATIVE EXAMPLE |
| 52 | 10.4 | 4.9 | 723 | 953 | 10.8 | GOOD | COMPARATIVE EXAMPLE |
| 53 | 22.8 | 5.6 | 1027 | 1123 | 8.6 | GOOD | COMPARATIVE EXAMPLE |
| 54 | 7.6 | 5.7 | 905 | 952 | 10.1 | GOOD | COMPARATIVE EXAMPLE |

*1 REFERENCIAL VALUE (HARDNESS OF FRESH MARTENSITE)
*2 REFERENCIAL VALUE (HARDNESS OF FRESH MARTENSITE)

As presented in Table 6 and Table 7, in the samples No. 1 to No. 26 within the range of the present invention, it was possible to obtain high tensile strength of 780 MPa or more, good elongation of 12% or more, and good bendability.

In the sample No. 27, the temperature of the tempering was excessively low, so that the martensite in the decarburized ferrite layer was not tempered.

For this reason, the volume fraction and the number density of the tempered martensite in the decarburized ferrite layer were insufficient, and the bendability was not good.

In the sample No. 28, the temperature of the tempering was excessively high, so that the austenite was decomposed. For this reason, the volume fraction of the retained austenite in the base material was insufficient, and the elongation and the tensile strength were low.

In the sample No. 29, the annealing temperature was excessively low, so that it was not possible to obtain the retained austenite. For this reason, the volume fraction of the retained austenite in the base material was insufficient, and the elongation was low.

In the sample No. 30, the average cooling rate of the first cooling was excessively low, so that the martensite was not sufficiently generated. For this reason, the volume fraction of the tempered martensite in the decarburized ferrite layer was insufficient, and the bendability was not good.

In the sample No. 31, the average cooling rate of the second cooling was excessively low, so that the pearlite was generated, and the generation of austenite was suppressed. For this reason, the volume fraction of the retained austenite in the base material was insufficient, and the elongation was low.

In the sample No. 32, the average cooling rate of the third cooling was excessively low, so that the austenite was decomposed. For this reason, the volume fraction of the retained austenite in the base material was insufficient, and the elongation was low.

In the samples No. 33, No. 35, and No. 40, the tempering was omitted, so that the martensite in the decarburized ferrite layer was not tempered. For this reason, the volume fraction of the tempered martensite in the decarburized ferrite layer was insufficient, and the bendability was not good.

In the sample No. 34, the Si content was excessively low, so that the volume fraction of the retained austenite in the base material was insufficient, and the elongation was low.

In the sample No. 36, the Mn content was excessively low, so that the volume fraction of the tempered martensite in the decarburized ferrite layer was insufficient, and the bendability was not good.

In the sample No. 37, the annealing temperature was excessively high, so that the tempered martensite in the decarburized ferrite layer was not sufficiently refined. For this reason, the number density of the tempered martensite in the decarburized ferrite layer was insufficient, and the bendability was not good.

In the sample No. 38, the temperature of the tempering was excessively high, so that the austenite was decomposed. For this reason, the volume fraction of the retained austenite in the base material was insufficient, and the elongation was low.

In the sample No. 39, the C content was excessively low, so that the tensile strength was low.

In the sample No. 41, the average heating rate of the heating was excessively high, so that the ferrite in the decarburized ferrite layer became coarse, and the tempered martensite was not sufficiently dispersed. For this reason, the average grain diameter of ferrite in the decarburized ferrite layer became excessively large, and the number density of the tempered martensite was insufficient, resulting in that the bendability was not good.

In the sample No. 42, the dew point in the annealing atmosphere was excessively low, so that the decarburized ferrite layer was not generated. For this reason, the thickness of the decarburized ferrite layer was insufficient, and the bendability was not good.

In the sample No. 43, the annealing time was excessively short, so that the decarburized ferrite layer was not generated. For this reason, the thickness of the decarburized ferrite layer was insufficient, and the bendability was not good.

In the sample No. 44, the average cooling rate of the first cooling was excessively high, so that the retained austenite was not sufficiently generated. For this reason, the volume fraction of the retained austenite in the base material was insufficient, and the elongation was low.

In the sample No. 45, the annealing time was excessively long, so that the decarburized ferrite layer was excessively grown. For this reason, the thickness of the decarburized ferrite layer became excessively large, and the tensile strength was low.

In the sample No. 46, the average heating rate of the heating was excessively low, so that the tempered martensite was not dispersed in the decarburized ferrite layer. For this reason, the volume fraction and the number density of the tempered martensite in the decarburized ferrite layer were insufficient, the tensile strength was low, and the bendability was not good.

In the sample No. 47, the temperature of the tempering was excessively low, so that the martensite in the decarburized ferrite layer was not sufficiently tempered. For this reason, the hardness of the tempered martensite in the decarburized ferrite layer became excessively large, and the bendability was not good.

In the sample No. 48, the temperature of the tempering was excessively high, so that the martensite in the base material was excessively tempered. For this reason, although the bendability was good, the average hardness of the tempered martensite in the base material was insufficient, and the tensile strength was low.

In the sample No. 49, the period of time of the tempering was excessively short, so that the martensite in the base material was not sufficiently tempered. For this reason, the average hardness of the tempered martensite in the base material became excessively large, and the bendability was not good.

In each of the samples No. 50 to No. 54, the temperature of the tempering was excessively high, so that the austenite was decomposed. For this reason, the volume fraction of the retained austenite in the base material was insufficient, and the elongation was low.

INDUSTRIAL APPLICABILITY

The present invention can be utilized for industry associated with a plated steel sheet suitable for automotive parts, for example.

The invention claimed is:

1. A plated steel sheet, comprising:
a steel sheet; and
a plating layer on the steel sheet, wherein:
the plating layer is a hot-dip galvanizing layer or an alloyed hot-dip galvanizing layer;
the steel sheet comprises:
a base material; and
a decarburized ferrite layer on the base material;
the base material includes a chemical composition represented by, in mass %:
C: 0.03% to 0.70%;
Si: 0.25% to 3.00%;
Mn: 1.0% to 5.0%;
P: 0.10% or less;
S: 0.0100% or less;
sol. Al: 0.001% to 1.500%;
N: 0.02% or less;
Ti: 0.0% to 0.300%;
Nb: 0.0% to 0.300%;
V: 0.0% to 0.300%;
Cr: 0% to 2.000%;
Mo: 0% to 2.000%;
Cu: 0% to 2.000%;
Ni: 0% to 2.000%;
B: 0% to 0.0200%;
Ca: 0.00% to 0.0100%;
REM: 0.0% to 0.1000%; and
a balance: Fe and impurities;
the base material includes a structure, at a position at which a depth from a surface of the steel sheet corresponds to ¼ of a thickness of the steel sheet, represented by, in volume fraction:
tempered martensite: 3.0% or more;
ferrite: 4.0% or more; and
retained austenite: 8.3% or more;
an average hardness of the tempered martensite in the base material is 5 GPa to 10 GPa;
a part or all of the tempered martensite and the retained austenite in the base material form a Martensite-Austenite constituent;
a volume fraction of ferrite in the decarburized ferrite layer is 120% or more of the volume fraction of the ferrite in the base material at the position at which the depth from the surface of the steel sheet corresponds to ¼ of the thickness of the steel sheet;
an average grain diameter of the ferrite in the decarburized ferrite layer is 20 μm or less;
a thickness of the decarburized ferrite layer is 5 μm to 200 μm;
a volume fraction of tempered martensite in the decarburized ferrite layer is 1.0 volume % or more;
a number density of the tempered martensite in the decarburized ferrite layer is $0.01/\mu m^2$ or more; and
an average hardness of the tempered martensite in the decarburized ferrite layer is 8 GPa or less.

2. The plated steel sheet according to claim 1, wherein, in the chemical composition,
Ti: 0.001% to 0.300%,
Nb: 0.001% to 0.300%, or
V: 0.001% to 0.300%,
or any combination thereof is satisfied.

3. The plated steel sheet according to claim 1, wherein, in the chemical composition,
Cr: 0.001% to 2.000%, or
Mo: 0.001% to 2.000%,
or both of them is satisfied.

4. The plated steel sheet according to claim 1, wherein, in the chemical composition,
Cu: 0.001% to 2.000%, or
Ni: 0.001% to 2.000%,
or both of them is satisfied.

5. The plated steel sheet according to claim 1, wherein, in the chemical composition, B: 0.0001% to 0.0200% is satisfied.

6. The plated steel sheet according to claim 1, wherein, in the chemical composition,
Ca: 0.0001% to 0.0100%, or
REM: 0.0001% to 0.1000%,
or both of them is satisfied.

* * * * *